US009372451B2

(12) United States Patent
Isono et al.

(10) Patent No.: US 9,372,451 B2
(45) Date of Patent: Jun. 21, 2016

(54) FIXING DEVICE

(71) Applicant: CANON KABUSHIKI KAISHA, Tokyo (JP)

(72) Inventors: Aoji Isono, Naka-gun (JP); Masatoshi Itoh, Mishima (JP); Yusuke Isomi, Yokohama (JP); Hiroshi Mano, Numazu (JP); Minoru Hayasaki, Mishima (JP); Yuki Nishizawa, Yokohama (JP); Akira Kuroda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/571,129

(22) Filed: Dec. 15, 2014

(65) Prior Publication Data

US 2015/0168894 A1 Jun. 18, 2015

(30) Foreign Application Priority Data

Dec. 18, 2013 (JP) ..... 2013-261515

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053
See application file for complete search history.

(56) References Cited

U.S. PATENT DOCUMENTS

| | | | | |
|---|---|---|---|---|
| 6,336,027 | B1 * | 1/2002 | Sakai et al. | 399/328 |
| 2003/0002882 | A1 * | 1/2003 | Takagi et al. | 399/69 |
| 2004/0037597 | A1 * | 2/2004 | Haseba et al. | 399/328 |
| 2005/0286938 | A1 * | 12/2005 | Aze et al. | 399/328 |
| 2006/0289420 | A1 * | 12/2006 | Hasegawa et al. | 219/216 |
| 2015/0132035 | A1 * | 5/2015 | Nishizawa et al. | 399/329 |

FOREIGN PATENT DOCUMENTS

| | | | |
|---|---|---|---|
| JP | 9-305043 | A | 11/1997 |
| JP | 10-123861 | A | 5/1998 |
| JP | 2001-100571 | A | 4/2001 |

* cited by examiner

*Primary Examiner* — Rodney Bonnette
(74) *Attorney, Agent, or Firm* — Canon USA Inc. IP Division

(57) ABSTRACT

In a fixing device, an alternating current is caused to flow through a coil so as to causes an electrically conductive layer of a rotating member to generate heat, and an unfixed image on a recording medium is heat fixed onto the recording medium by the heat generated by the electrically conductive layer. A frequency range of the alternating current is from 20.5 kHz to 100 kHz. With respect to a generatrix direction of the rotating member, a magnetic member and a spirally shaped portion of the coil have lengths, with which the magnetic member and the spirally shaped portion extend beyond both end portions of the rotating member.

4 Claims, 19 Drawing Sheets

FIXING DEVICE

BACKGROUND OF THE INVENTION

1. Field of the Invention

The present invention relates to fixing devices provided in image forming apparatuses such as electrophotographic copiers and printers.

2. Description of the Related Art

In some fixing devices provided in image forming apparatuses such as electrophotographic copiers and printers, heat is generated by rotating members for fixing by utilizing the principle of electromagnetic induction. A technique for improving heat generation at end portions of the rotating member, where the amount of generated heat tends to be insufficient, has been proposed (Japanese Patent Laid-Open No. 9-305043).

Despite this, it is still demanded that heat generation efficiency is improved by reducing the magnetic flux not contributing to the heat generation by the rotating member and increasing the magnetic flux contributing to the heat generation by the rotating member while improving heat generation at end portions of the rotating member, where the amount of generated heat tends to be insufficient.

SUMMARY OF THE INVENTION

The present invention provides a fixing device, which features good heat generation efficiency, and in which heat generation at end portions of a rotating member, where the amount of generated heat tends to be insufficient, is improved.

According to a first aspect of the present invention, a fixing device includes a cylindrical rotating member, a magnetic member, and a coil. The rotating member includes an electrically conductive layer. The magnetic member is provided inside the rotating member and extends in a generatrix direction of the rotating member. The coil is wound around the magnetic member. In the fixing device, an alternating current is caused to flow through the coil so as to induce a current in the electrically conductive layer, the induced current causes the electrically conductive layer to generate heat, and an unfixed image on a recording medium is heat fixed onto the recording medium by the heat generated by the electrically conductive layer. In the fixing device, a frequency range of the alternating current is from 20.5 kHz to 100 kHz. In the fixing device, with respect to the generatrix direction, the magnetic member and a spirally shaped portion of the coil have lengths, with which the magnetic member and the spirally shaped portion extend beyond both end portions of the rotating member.

According to a second aspect of the present invention, a fixing device includes a cylindrical rotating member, a magnetic member, and a coil. The rotating member includes an electrically conductive layer. The magnetic member is provided inside the rotating member and extends in a generatrix direction of the rotating member. The coil is wound around the magnetic member. In the fixing device, an alternating current is caused to flow through the coil so as to induce a current in the electrically conductive layer, the induced current causes the electrically conductive layer to generate heat, and an unfixed image on a recording medium is heat fixed onto the recording medium by the heat generated by the electrically conductive layer. In the fixing device, the magnetic member has an end and does not form a loop. In the fixing device, with respect to the generatrix direction, the magnetic member and a spirally shaped portion of the coil have lengths, with which the magnetic member and the spirally shaped portion extend beyond both end portions of the rotating member.

Further features of the present invention will become apparent from the following description of exemplary embodiments with reference to the attached drawings.

DESCRIPTION OF THE EMBODIMENTS

First Embodiment

Figure 1:
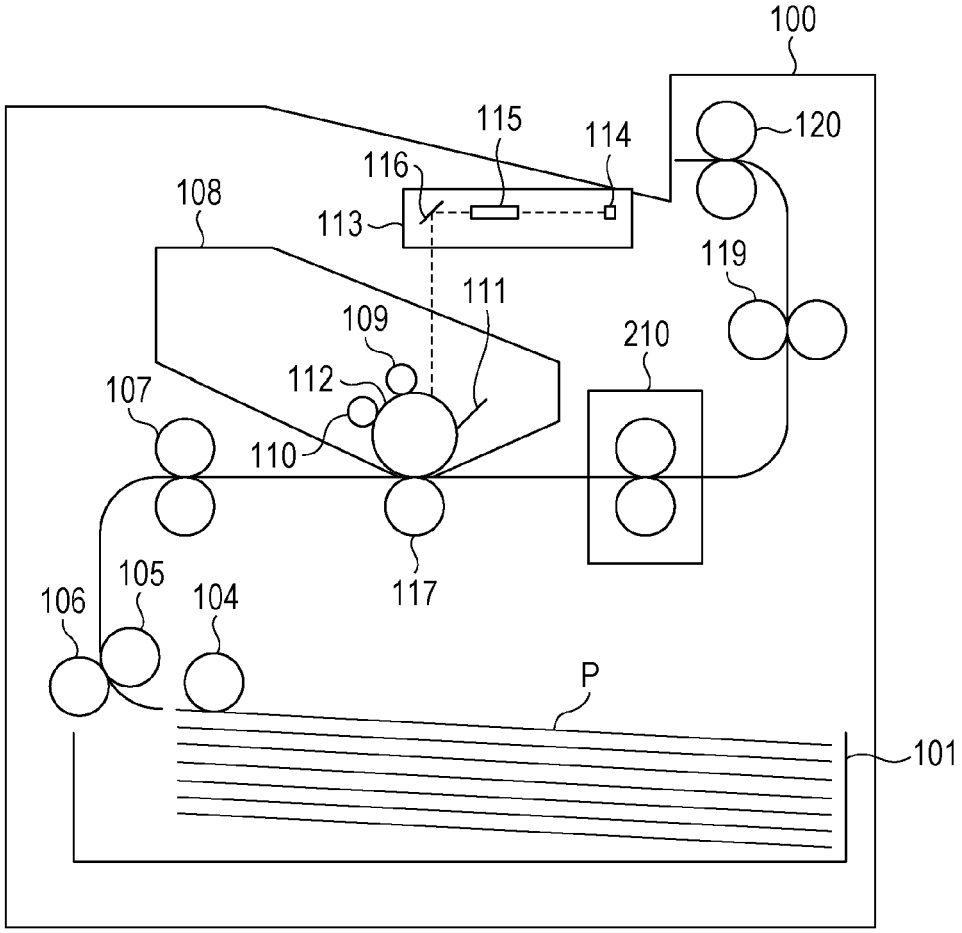
FIG. 1 is a sectional view of an image forming apparatus.

FIG. 1 illustrates a configuration of an image forming apparatus 100 in which a fixing device according to the present invention is provided. The image forming apparatus 100 includes a sheet supplying cassette 101 that contains recording sheets of paper P as recording media. Reference numeral 104 denotes a pickup roller, by which the recording sheets P stacked one on top of another in the sheet supplying cassette 101 are picked up. Reference numeral 105 is a feed roller that conveys the recording sheets P picked up by the pickup roller 104. Reference numeral 106 denotes a retard roller that allows a single sheet P to be supplied. The supplied recording sheet P is conveyed to an image forming section at specified timing by a registration roller 107. The image forming section includes a photosensitive member 112, a charger 109, a laser scanner 113, and a developing unit 110. The charger 109 charges the photosensitive member 112. The laser scanner 113 scans the photosensitive member 112 with laser light in accordance with image information. The developing unit 110 develops an electrostatic latent image formed on the photosensitive member 112 with toner. Furthermore, the image forming section includes a transfer unit 117 and so forth. The transfer unit 117 transfers a toner image from the photosensitive member 112 to the recording sheet P. The toner image formed on the photosensitive member 112 is transferred onto the recording sheet P by the transfer unit 117. Since the above-described image forming process is known, detailed description is omitted. Reference numeral 111 denotes a cleaner that cleans the photosensitive member 112. Reference numeral 108 denotes a frame of a process cartridge that houses the components such as the photosensitive member 112 and the developing unit 110 and is replaceably provided in an image forming apparatus main body. The laser scanner 113 includes a semiconductor laser 114, a polygon mirror 115, a mirror 116, and so forth. The polygon mirror 115 deflects the laser light emitted from the semiconductor laser 114. The mirror 116 directs the laser light toward the photosensitive member 112. The recording sheet P, onto which the toner image has been transferred, is conveyed to a fixing device 210, in which the toner image is heat fixed onto the recording sheet P. The recording sheet P having undergone the fixing process is ejected to the outside of the image forming apparatus 100 by eject rollers 119 and 120. Thus, a series of printing operations have been performed.

Figure 2:
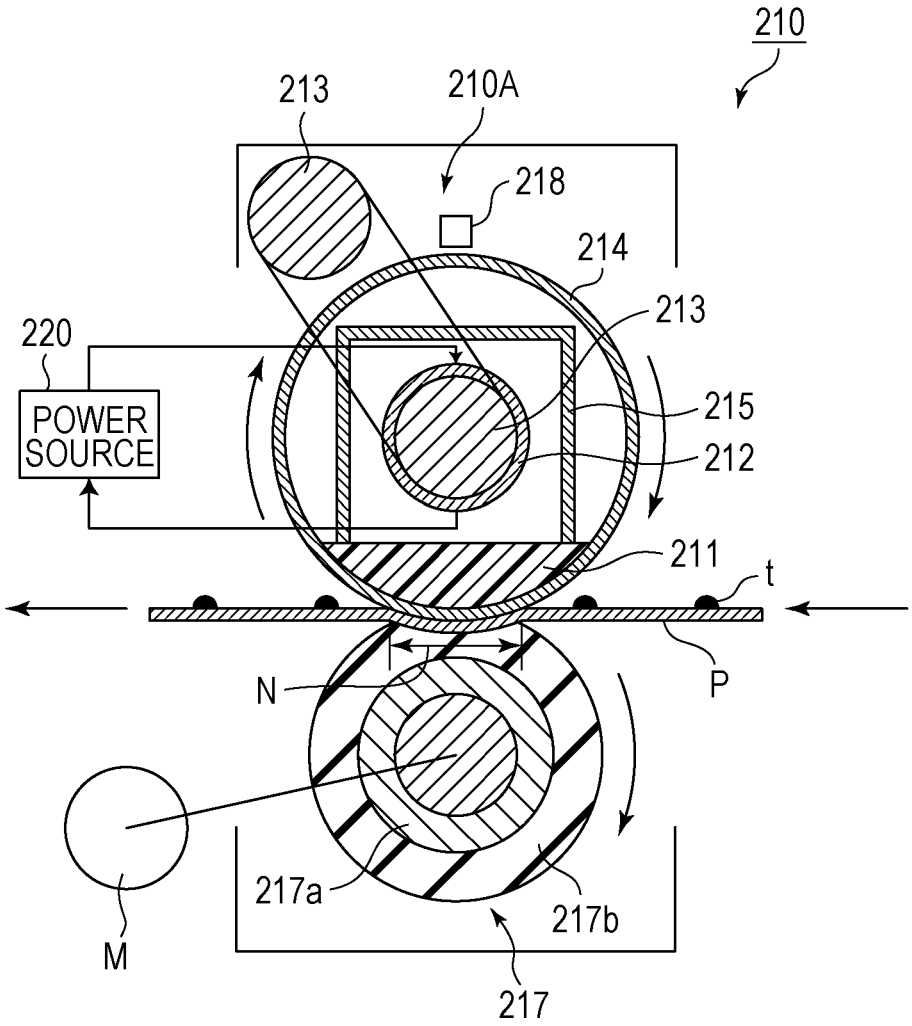
FIG. 2 is a sectional view of a fixing device according to a first embodiment.
Figure 3:
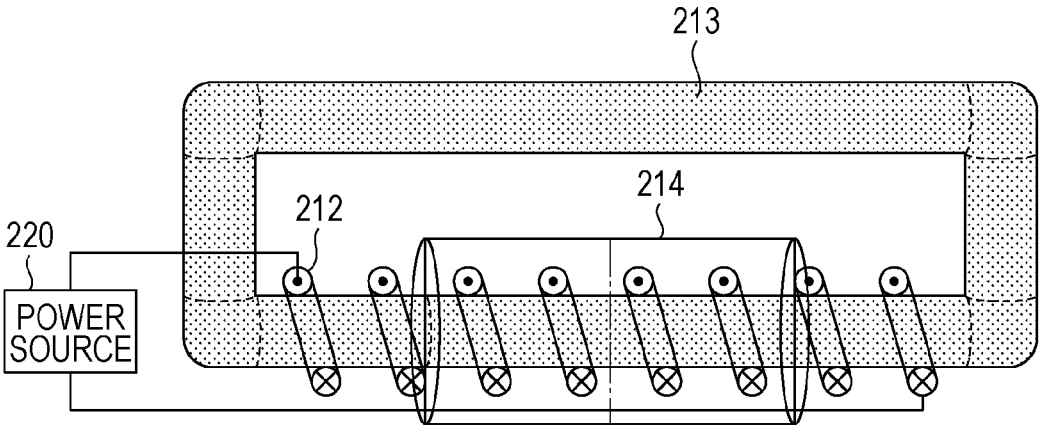
FIG. 3 illustrates a configuration of a coil and core in the fixing device according to the first embodiment.

FIGS. 2 and 3 are schematic views of the fixing device 210 according to the present embodiment. The fixing device 210 is made by assembling together a film unit 210A and a drive roller 217. The recording sheet P, on which an unfixed toner image t has been formed, is heated while being nipped and conveyed by a fixing nip portion N. Thus, the image t is heat fixed onto the recording sheet P.

The film unit 210A includes a cylindrical rotating member 214 that includes an electrically conductive layer. An induced current flows through the electrically conductive layer. In the present embodiment, the rotating member 214 uses a fixing film (also referred to as a belt). The electrically conductive layer is formed of a non-magnetic material, and specifically, formed of a metal such as silver, aluminum, austenitic stainless steel, copper, or an alloy of one of these materials. A magnetic core (magnetic member) 213 and a coil 212 wound around the magnetic core 213 are provided inside the cylinder of the film 214.

The core 213 is a ferromagnetic body formed of an alloy material or an oxide having a high permeability such as sintered ferrite, ferrite resin, an amorphous alloy, or a permalloy. As illustrated in FIG. 3, the core 213 has a closed annular shape with part thereof extending in a generatrix direction of the film 214 inside the cylinder of the film 214. The coil 212 is spirally wound around the core 213 such that the spiral axis thereof extends parallel to the generatrix direction of the film 214.

A backup member 211, which is in contact with an inner surface of the film 214 so as to back up the film 214 from inside is provided inside the film 214. The backup member 211 of the present embodiment also has a function of guiding rotation of the film 214. The backup member 211 is formed of a heat resistant resin such as polyphenylene-sulfide (PPS) or liquid crystal polymer (LCP). A slide layer formed of a non-magnetic metal or a resin such as fluoroplastic or polyimide may be provided on a surface of the backup member 211 in contact with the film 214.

A stay 215, which is a metal plate reinforcing the backup member 211, is formed of a non-magnetic material. Since the stay 215 is subjected to a large load of about 100 to 500 N, the material of the stay 215 needs to have a high strength. Specifically, the stay 215 is formed of a metal such as aluminum or austenitic stainless steel, or an alloy of one of these metals. Furthermore, in order for the stay 215 to have a sufficient moment of inertia of area, the stay 215 is formed by bending a metal plate having a thickness of 1 to 3 mm so as to have a U-shaped section. In the present embodiment, a 1.5 mm thick austenitic stainless steel plate is bent to have a U-shaped section. Reference numeral 218 denotes a temperature sensor that monitors the temperature of the film 214. The temperature sensor 218 is not in contact with an outer surface of the film 214.

The roller 217 includes a cored bar 217*a* and an elastic layer 217*b*, which is formed of a silicone rubber or fluoroplastic rubber and coated over the cored bar 217*a*. The cored bar 217*a* and the stay 215 are subjected to a pressure by a spring (not illustrated), thereby the fixing nip portion N is formed between the backup member 211 and the roller 217 with the film 214 interposed therebetween. The roller 217 is driven by a motor M. The film 214 is rotated by the rotation of the roller 217.

Reference numeral 220 denotes a high-frequency power source (power supply device) that causes a high-frequency current (alternating current) to flow through the coil (energizing coil) 212. When the high-frequency current is supplied from the power source 220 to the coil 212, an electromotive force is generated in a circumferential direction of the film 214, thereby generating Joule heat in accordance with the resistance of the film 214. This causes the entirety of the film 214 to generate heat due to electromagnetic induction. That is, in the fixing device, an alternating current is caused to flow through the coil so as to induce a current in the electrically conductive layer of the film. This causes the electrically conductive layer to generate heat, and an unfixed image on the recording medium is heat fixed onto the recording medium by the heat generated by the electrically conductive layer. The frequency range of the high-frequency current flowing through the coil is from 20.5 to 100 kHz.

The temperature of the film 214 is detected by the temperature sensor 218, and information on the detected temperature is input to a control circuit of the power source 220. The power source 220 controls the high-frequency current supplied to the coil 212 so that the temperature of the film 214 becomes a specified control target temperature (fixing temperature).

As illustrated in FIG. 3, with respect to the generatrix direction of the film 214, both end portions of the magnetic core 213 and both end portions of the spirally shaped portion of the coil 212 extend to the outside of respective end portions of the film 214. In other word, with respect to the generatrix direction of the rotating member 214, the magnetic member 213 and the spirally shaped portion of the coil 212 have the lengths, with which the magnetic member 213 and the spirally shaped portion extend beyond both the end portions of the rotating member 214.

Figure 4A:
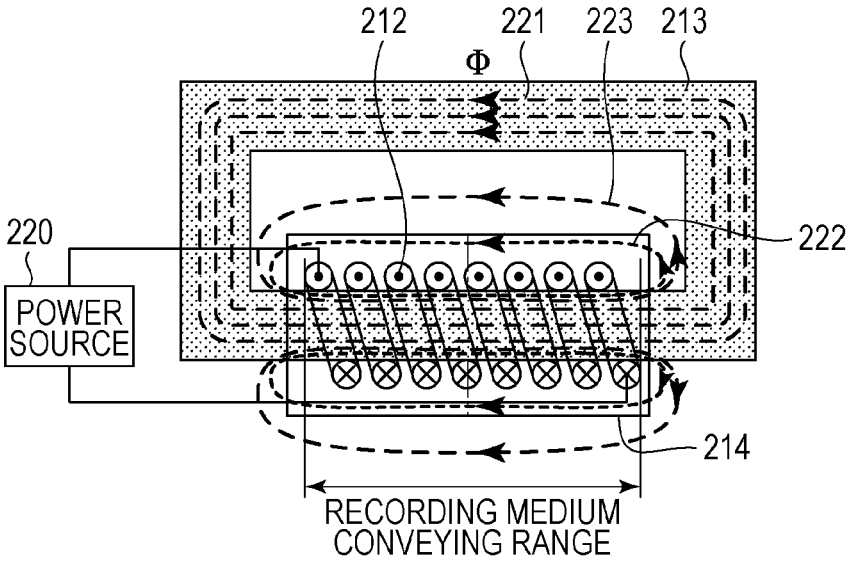
FIGS. 4A and 4B explain magnetic fluxes formed by the fixing device according to the first embodiment.
Figure 4B:
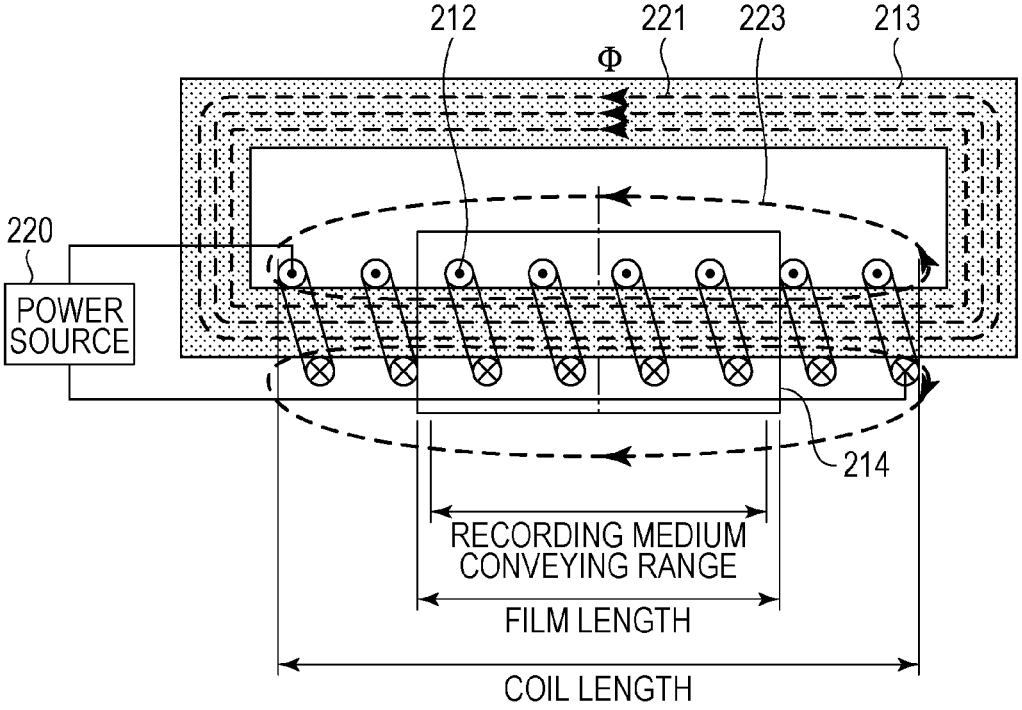
Figure 5A:
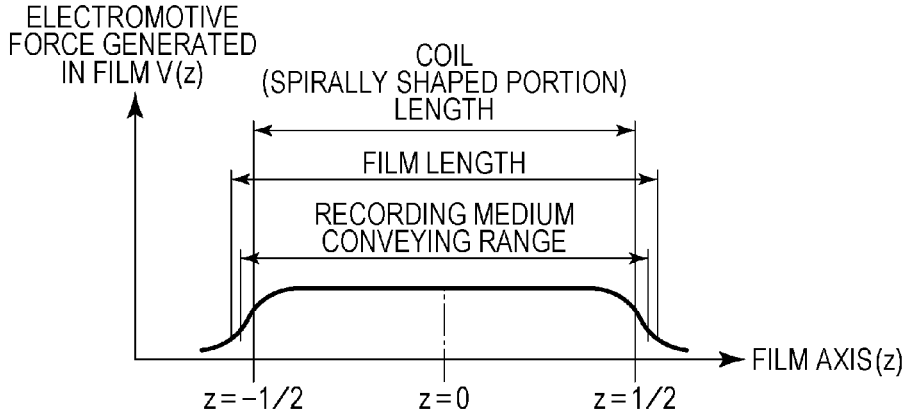
FIGS. 5A and 5B illustrate a distribution of an electromotive force generated in a film.
Figure 5B:
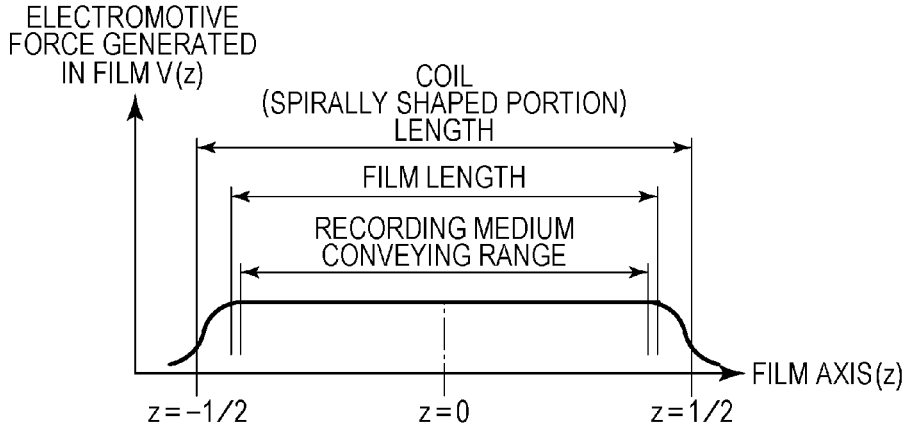

FIG. 4A illustrates a first comparative example, explaining magnetic fluxes generated in the coil 212 when the length of spirally shaped portion of the coil 212 is equal to or less than the length of the film 214 (the spirally shaped portion is within a range between both the end portions of the film 214). FIG. 4B explains the magnetic fluxes in the configuration, in which both the end portions of the spirally shaped portion of the coil 212 extend to the outside of the respective ends of the film 214 as in the present embodiment. FIGS. 5A and 5B illustrate a distribution of the electromotive force V(z) generated in the film 214 in the configurations illustrated in FIGS. 4A and 4B, respectively.

When the high-frequency current flows from the power source 220 to the coil 212, magnetic fluxes 221 to 223 are generated. The magnetic flux 221 passes through the inside of the core 213, the magnetic flux 222 passes through the inside of the film 214, and the magnetic flux 223 passes through between part of the core 213 located outside the film 214 and the film 214. The directions of the magnetic fluxes 221 to 223 change in accordance with time variation of the high-frequency current. Furthermore, an electromotive force is generated in the circumferential direction of the film 214 in accordance with time variation of the magnetic fluxes. The electromotive force generated in the circumferential direction of the film 214 induces the current in the circumferential direction of the film 214. Joule heat is generated by the resistance in the circumferential direction of the film 214. This Joule heat causes the film 214 to generate heat.

As illustrated in FIG. 4A, the direction of the magnetic flux 222 passing through the inside of the film 214 is opposite to the direction of the magnetic flux passing through the inside of part of the core where the coil 212 is wound. Thus, inside the film 214, the magnetic flux 222 and the magnetic flux 221 cancel out each other, thereby reducing the magnetic flux 221 passing through inside the core 213. That is, out of the magnetic fluxes generated by the high-frequency current supplied from the power source to the coil, the magnetic flux contributing to heat generation reduces. In a configuration in which the magnetic flux 222 is increased as this, heat generation efficiency is reduced.

In contrast, as illustrated in FIG. 4B, in the configuration in which both the end portions of the spirally shaped portion of the coil 212 extend to the outside of the respective end portions of the film 214 with respect to the generatrix direction of the film 214, the magnetic flux 222 passing through the inside of the film 214 reduces. Thus, part of the magnetic flux 222 illustrated in FIG. 4A is replaced with the magnetic flux 221 or 223. This improves the heat generation efficiency.

When the radius of the coil 212 is r, the length of the spirally shaped portion of the coil 212 is 1, the number of turns of the coil 212 per unit length is n, the permeability of the core 213 is μ, the current flowing through the coil 212 is I(t), and the center in the film generatrix direction in the spirally shaped portion z=0, a magnetic field strength H(z) at the center of the core at an arbitrary position z is expressed by equation (1) as follows:

$$H(z) = \frac{nI(t)}{2} * \int_{\frac{1}{2}}^{\frac{1}{2}} \left( \frac{z+\frac{1}{2}}{\sqrt{r^2+\left(z+\frac{1}{2}\right)^2}} - \frac{z-\frac{1}{2}}{\sqrt{r^2+\left(z-\frac{1}{2}\right)^2}} \right) dz. \quad (1)$$

Furthermore, the magnetic flux Φ(z) inside the coil 212 at the arbitrary position z is given by Φ(z)=μH(z)·2πr^2. When the permeability μ of the core is sufficiently larger than that in vacuum, an electromotive force V(z) generated in the film 214 at the arbitrary position z is mainly affected by the magnetic flux inside the coil 212 and can be expressed by equation (2) as follows:

$$V(z) = -\mu * (2\pi r^2) * \frac{dH(z)}{dt} \quad (2)$$

$$V(z) = -\mu * (2\pi r^2) * \frac{n}{2} * \frac{dI(t)}{dt} * \int_{\frac{1}{2}}^{\frac{1}{2}} \left( \frac{z+\frac{1}{2}}{\sqrt{r^2+\left(z+\frac{1}{2}\right)^2}} - \frac{z-\frac{1}{2}}{\sqrt{r^2+\left(z-\frac{1}{2}\right)^2}} \right) dz.$$

Thus, in the configuration as illustrated in FIG. 4A, the electromotive force generated in the circumferential direction of the film 214 in accordance with time variation of the high-frequency current reduces at the end portions of a film range as illustrated in FIG. 5A. Accordingly, the amount of heat generated at the end portions of the film 214 is reduced. This may lead to a failure in the fixing of the toner image in these regions.

In contrast, in the configuration as illustrated in FIG. 4B, the range where the electromotive force reduces can be located outside each end portion of the film 214 as illustrated in FIG. 5B. Thus, reduction in the amount of heat generation at the end portions of the film 214 can be suppressed.

Figure 20:
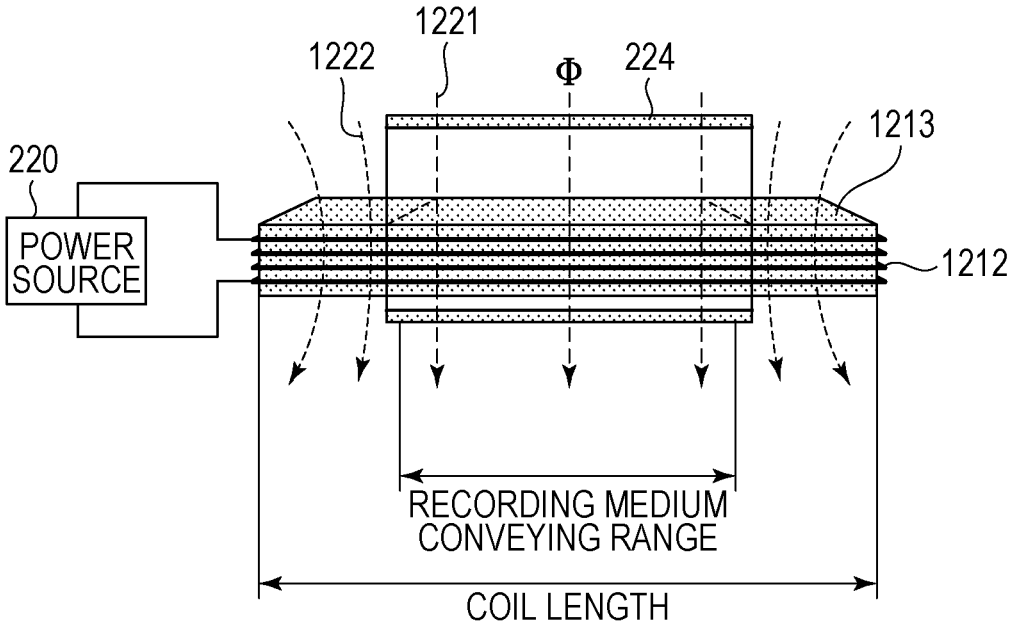
FIG. 20 illustrates a configuration of a comparative example.

Referring next to FIG. 20, a device of a second comparative example, in which the coil is wound in a non-spiral manner, is described. In the device illustrated in FIG. 20, a core 1213 has a length with which the core 1213 extends beyond both ends of a cylinder of an electrically conductive film 224. A coil 1212 is wound around the core 1213 such that the magnetic flux generated by the high-frequency current flowing through the coil 212 is substantially perpendicular to a surface of the film 224. When the high-frequency current flows from the power source 220 to the coil 1212, a magnetic flux 1221 and a magnetic flux 1222 are generated. By the magnetic flux 1221 penetrating through the film 224, eddy currents are generated in the electrically conductive layer of the film 224, thereby causing the film 224 to generate heat. Since the lengths of the core and the coil are set to be larger than the length of the film, reduction in the amount of heat generation at the end portions of the film can be suppressed.

However, as can be understood from FIG. 20, the magnetic flux 1222 generated at each end portion of the coil 1212 does not contribute to heat generation of the film 224. Even when the coil is wound in the manner as illustrated in FIG. 20, out of the magnetic fluxes generated by the high-frequency current supplied from the power source 220 to the coil 1212, the magnetic fluxes contributing to the heat generation are reduced, and accordingly, heat generation efficiency is reduced.

As has been described, in the present embodiment, the magnetic core is provided inside the rotating member in the generatrix direction of the rotating member, and the coil is spirally wound around the magnetic core such that the spiral axis of the coil is parallel to the generatrix direction. Furthermore, with respect to the generatrix direction of the rotating member, both the end portions of the magnetic core and both the end portions of the spirally shaped portion of the coil extend to the outside the respective end portions of the rotating member.

In such a structure, reduction in the heat generation efficiency and unevenness in the heat generation of the rotating member can be suppressed.

Second Embodiment

Next, a second embodiment will be described with reference to FIGS. 6A to 17B. The difference between the first and second embodiments is that, in the second embodiment, the magnetic core has ends. Elements similar to those in the first embodiment are denoted by similar reference numerals and description thereof is omitted.

Figure 14:
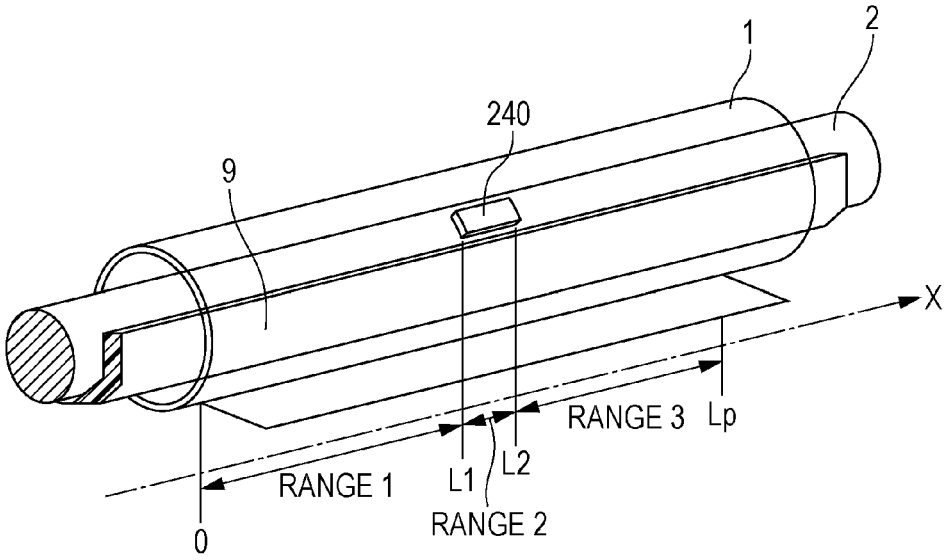
FIG. 14 is a perspective view of the magnetic core, a temperature detecting member, and the film that includes an electrically conductive layer.
Figure 15A:
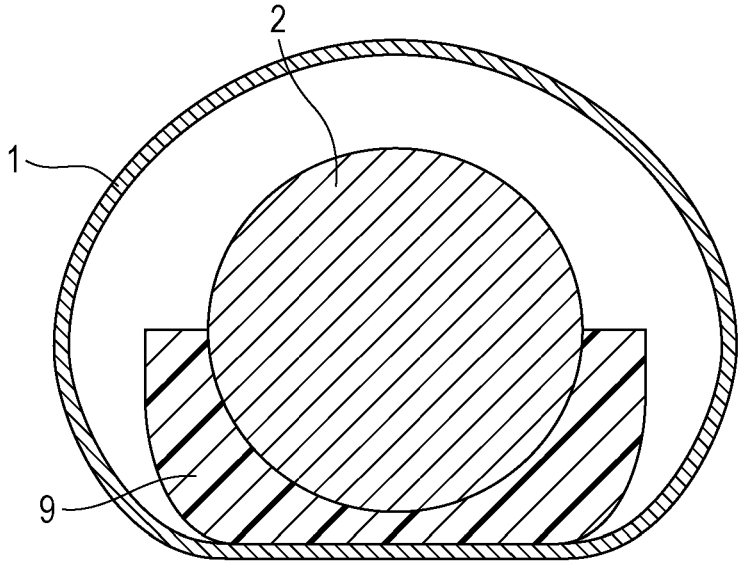
FIGS. 15A and 15B are sectional views of the magnetic core, the temperature detecting member, and the film that includes the electrically conductive layer.
Figure 15B:
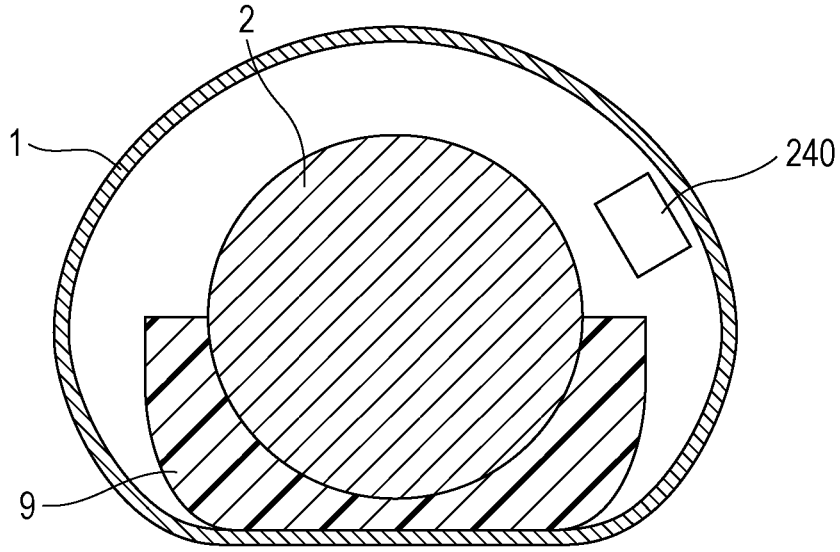
Figure 16:
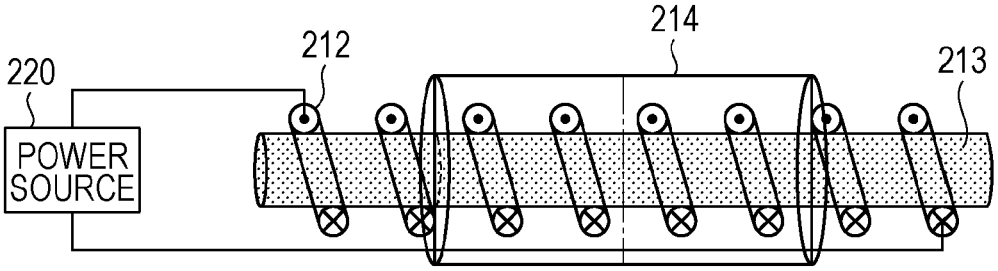
FIG. 16 illustrates a configuration of a coil and core in the fixing device according to the second embodiment.

When an annular (closed loop) core is used as in the first embodiment, a region, through which the magnetic flux (lines of magnetic force) passes, can be easily determined, and accordingly, a fixing device with high heat generation efficiency can be provided. However, the size of such a fixing device tends to increase. When the core has the ends (open loop), the increase in the size of the device can be suppressed. However, the magnetic flux exiting the core through the end portions of the core cannot be constrained, and accordingly, it is unlikely that the heat generation efficiency is increased by increasing the magnetic flux contributing the heat generation. The conditions for the fixing device, in which the induced current flowing in the circumferential direction of the rotating member can be increased (heat generation efficiency can be improved) with the core having the ends, is described by using a model. FIGS. 6A to 15B explain the conditions for the fixing device in which the induced current flowing in the circumferential direction of the rotating member can be increased. In FIGS. 6A to 15B, reference numeral 1 denotes a rotating member (film) 1 having an electrically conductive layer 1*a*, reference numeral 2 denotes a magnetic core, and reference numeral 3 denotes a coil. FIGS. 16 to 17B illustrate specific configurations of the present embodiment.

(1) Heat Generating Mechanism of Fixing Device of Present Embodiment

Figure 6A:
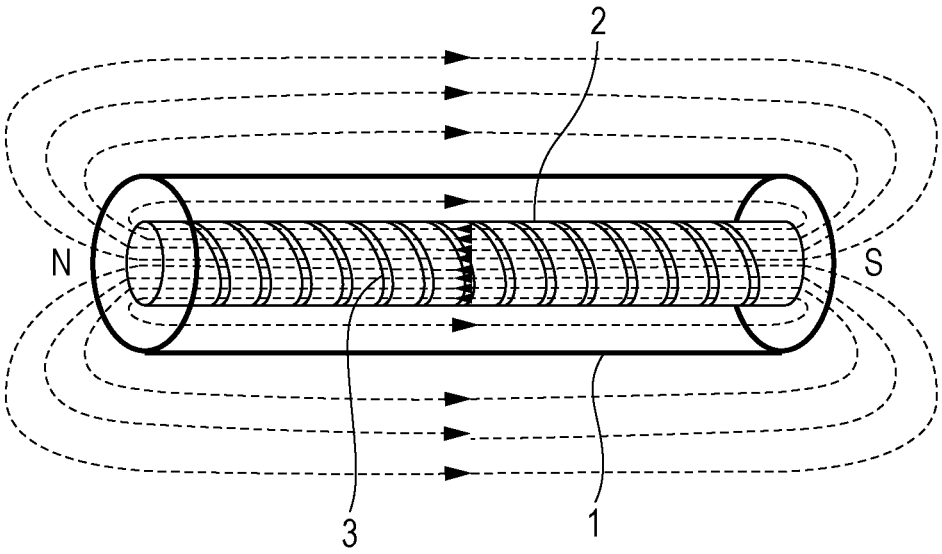
FIGS. 6A and 6B are explanatory views of a heat generation mechanism of a fixing device according to a second embodiment.

Referring to FIG. 6A, a heat generating mechanism of the fixing device of the present embodiment is described. The lines of magnetic force generated by causing the alternating current to flow through the coil 3 pass through the inside of the magnetic core 2 in the generatrix direction of the electrically conductive layer 1*a* (direction from south pole to north pole), exit the magnetic core 2 through one end (north pole) to the outside of the electrically conductive layer 1*a*, and return to the magnetic core 2 through another end (south pole). An induced electromotive force is generated in the electrically conductive layer 1*a* so as to form a magnetic flux that cancels out a magnetic flux formed by the coil 3, and a current is induced in the circumferential direction of the electrically conductive layer 1*a*. Joule heat due to the induced current causes the electrically conductive layer 1*a* to generate heat. The magnitude of the induced electromotive force V generated in the electrically conductive layer 1*a* is, as given in equation (3) below, proportional to the amount of change in the magnetic flux passing through the inside of the electrically conductive layer 1*a* per unit time ($\Delta\phi/\Delta t$) and the number of turns N of the coil 3.

$$V = -\frac{N\Delta\Phi}{\Delta t}. \tag{3}$$

Figure 6B:
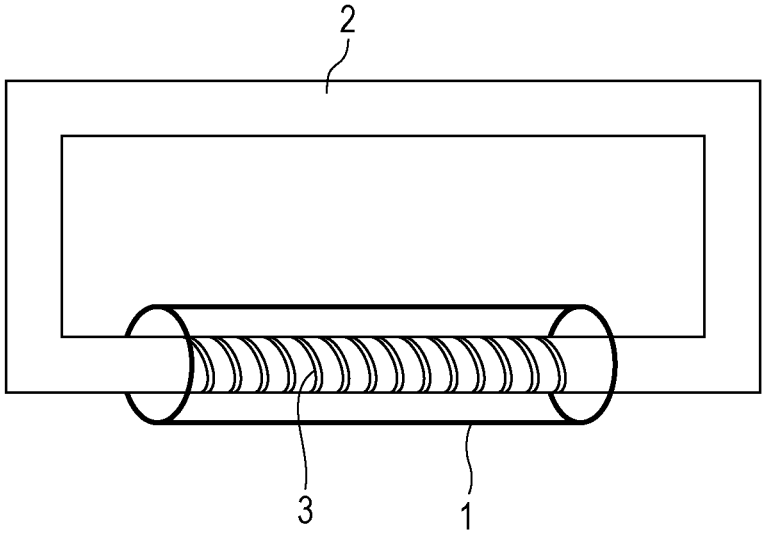

(2) Relationship Between Ratio of Magnetic Flux Passing Outside Electrically Conductive Layer and Power Conversion Efficiency The magnetic core 2 illustrated in FIG. 6A does not have a loop shape but has the end portions. When the magnetic core 2 has a loop shape outside the electrically conductive layer 1*a* as illustrated in FIG. 6B in the fixing device, the lines of magnetic force are directed by the magnetic core so that the lines of magnetic force exit the inside of the electrically conductive layer 1*a* to the outside and then return to the inside of the electrically conductive layer 1*a*. However, when the magnetic core 2 has the end portions as in the present embodiment, the lines of magnetic force having exited the magnetic core 2 through the end portions of the magnetic core 2 are not directed. Thus, the lines of magnetic force having exited the magnetic core 2 through one end portion of the magnetic core 2 return to another end of the magnetic core 2 (from the north pole to the south pole) through an outside route, which extends outside the electrically conductive layer 1*a*, and an inside route, which extends inside the electrically conductive layer 1*a*. Hereafter, the outside route refers to the route directed from the north pole to the south pole of the magnetic core 2 outside the electrically conductive layer 1*a*, and the inside route refers to the route directed from the north pole to the south pole of the magnetic core 2 through the inside of the electrically conductive layer 1*a*.

The ratio of the lines of magnetic force passing through the outside route to the lines of magnetic force having exited through the one end of the magnetic core 2 is correlated to power consumed for generating heat (power conversion efficiency) by the electrically conductive layer 1*a* among the power input to the coil 3 and an important parameter. As the ratio of the lines of magnetic force passing through the outside route increases, the ratio of the power consumed for generating heat (power conversion efficiency) by the electrically conductive layer 1*a* to the power input to the coil 3 increases. The reason for this is similarly explained by a principle in which, when leakage flux is sufficiently small in a transformer and the numbers of the lines of magnetic force passing through the primary winding and the secondary winding of the transformer are equal to each other, the power conversion efficiency increases. That is, when the difference between the numbers of the lines of magnetic force passing through inside the magnetic core and outside the magnetic core reduces, the power conversion efficiency increases, and accordingly, electromagnetic induction can be effectively performed with the high-frequency current flowing through the coil as a circulating current in the electrically conductive layer.

Referring to FIG. 6A, the direction of the lines of magnetic force directed from the south pole to the north pole inside the core is opposite to the direction of the lines of magnetic force passing through the inside route. Thus, these lines of magnetic force passing through the inside the core and the inside route cancel out one another. As a result, the number of the lines of magnetic force (magnetic flux) passing through the entirety of the inside of the electrically conductive layer 1*a* from the south pole to the north pole reduces, and accordingly, the amount of change in the magnetic flux per unit time reduces. When the amount of change in the magnetic flux per unit time reduces, the induced electromotive force generated in the electrically conductive layer 1*a* reduces, thereby reducing the amount of heat generated by the electrically conductive layer 1*a*.

Accordingly, in order to improve the power conversion efficiency, it is important to control the ratio of the lines of magnetic force passing through the outside route.

(3) Index Indicating Ratio of Magnetic Flux Passing Outside Electrically Conductive Layer The ratio of the lines of magnetic force passing through the outside route is represented by an index referred to as permeance that indicates the degree of ease at which the lines of magnetic force pass. Initially, a general concept of magnetic circuitry is described. A circuit of a magnetic path through which the lines of magnetic force pass is referred to as a magnetic circuit similarly to an electric circuit, through which electricity passes. The magnetic flux in the magnetic circuit can be calculated similarly to calculation of current in the electric circuit. The Ohm's law regarding the electric circuit is applicable to the magnetic circuit. When a magnetic flux, which corresponds to a current in the electric circuit, is Φ, a magnetomotive force, which corresponds to an electromotive force in the electric circuit, is V, and reluctance, which corresponds to resistance in the electric circuit, is R, the following equation (4) is satisfied:

$$\Phi\Phi=V/R \quad (4).$$

Here, for ease of understanding of the principle, permeance P, which is the reciprocal of reluctance R, is used in the description. When using permeance P, the above-described equation (4) can be expressed by, for example, the following equation (5):

$$\Phi\Phi=V\times P \quad (5).$$

Furthermore, when the length of a magnetic path is B, the sectional area of the magnetic path is S, and the permeability of the magnetic path is μ, permeance P can be expressed by, for example, the following equation (6):

$$P=\mu\times S/B \quad (6).$$

Permeance P is proportional to the sectional area S and permeability μ and inversely proportional to the length B of the magnetic path.

Figure 7A:
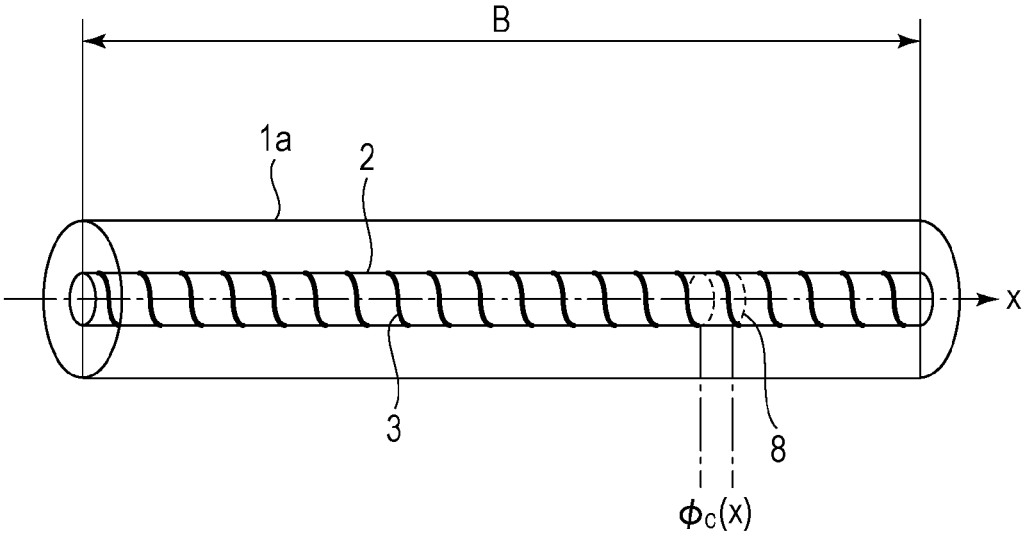
FIGS. 7A and 7B are schematic views of a structure in which a finite length solenoid is disposed.
Figure 7B:
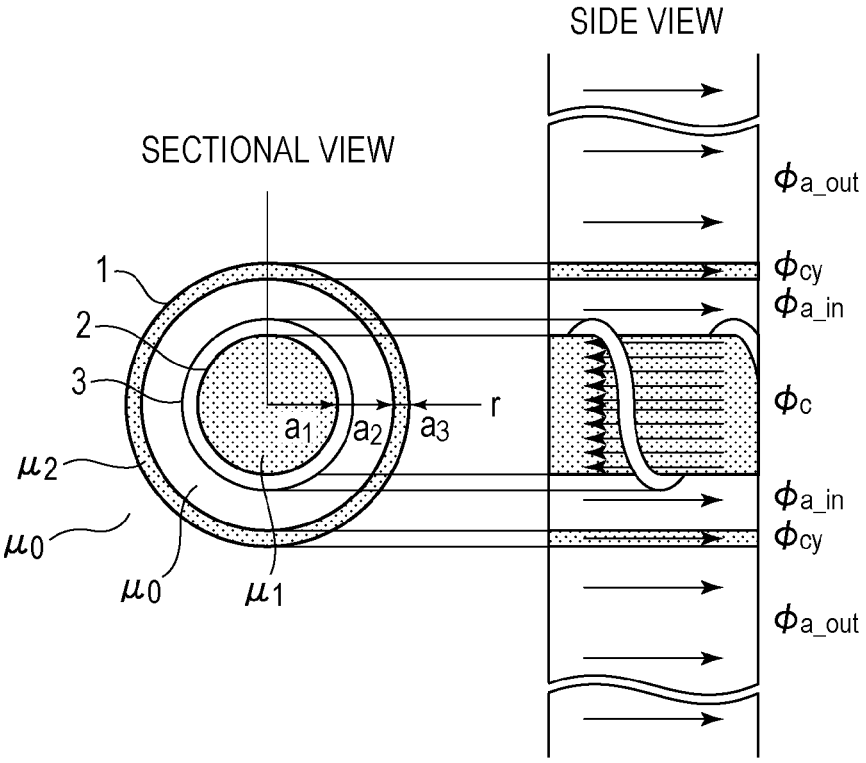

FIG. 7A illustrates a structure in which the coil 3 is wound N times around the magnetic core 2, which has a radius of $a_1$ m, a length of B m, and a relative permeability of $\mu_1$, such that the spiral axis of the coil 3 is substantially parallel to the generatrix direction of the electrically conductive layer 1*a* inside the electrically conductive layer 1*a*. Here, the electrically conductive layer 1*a* is a conductor having a length of B m, an inner diameter of $a_2$ m, an outer diameter of $a_3$ m, and a relative permeability of $\mu_2$. The permeability of vacuum inside and outside the electrically conductive layer 1*a* is $\mu_0$ H/m. When a current of I A flows through the coil 3, a magnetic flux 8 generated per unit length of the magnetic core 2 is $\phi_c(x)$. FIG. 7B is a sectional view perpendicular to a longitudinal direction of the magnetic core 2. Arrows in FIG. 7B indicate magnetic fluxes, which pass through the inside of the magnetic core 2, the inside of the electrically conductive layer 1*a*, and the outside of the electrically conductive layer 1*a* and are parallel to the longitudinal direction of the magnetic core 2 when the current I flows through the coil 3. The magnetic flux passing through the inside of the magnetic core 2 is $\phi_c$ ($=\phi_c(x)$), the magnetic flux passing through the inside of the electrically conductive layer 1*a* (region between the electrically conductive layer 1*a* and the magnetic core 2) is $\phi_{a_in}$, the magnetic flux passing through the electrically conductive layer 1*a* itself is $\phi_s$, and the magnetic flux passing through the outside of the electrically conductive layer 1*a* is $\phi_{a_out}$.

Figure 8A:
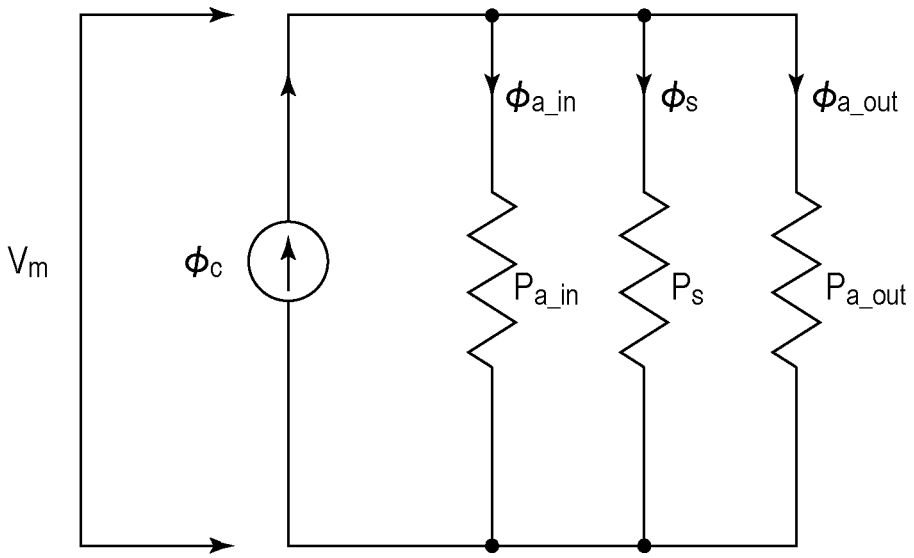
FIGS. 8A and 8B illustrate a magnetically equivalent circuit of a space including a core, a coil, and a cylindrical member per unit length.
Figure 8B:
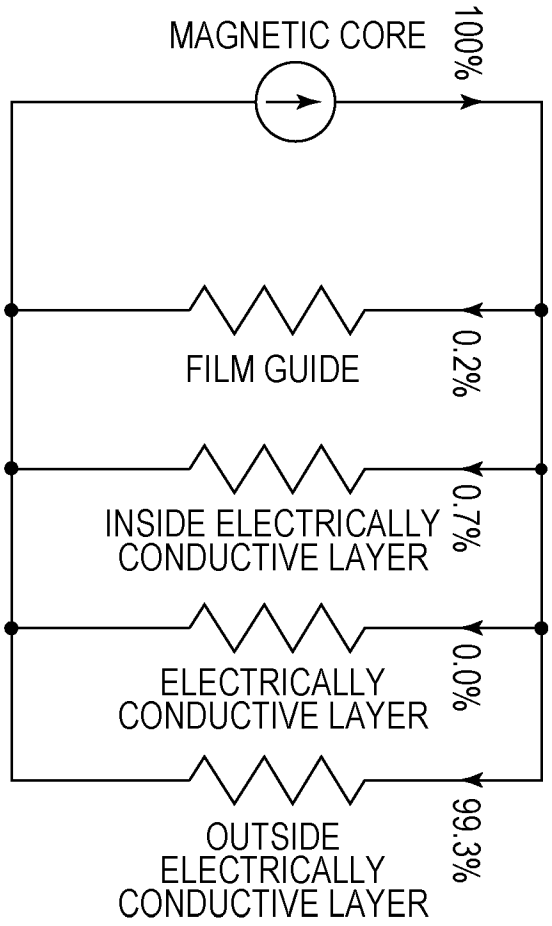

FIG. 8A is a magnetically equivalent circuit of a space per unit length illustrated in FIG. 6A including the core 2, the coil 3, and the electrically conductive layer 1*a*. $V_m$ represents a magnetomotive force generated by the magnetic flux $\phi_c$ passing through the magnetic core 2, $P_c$ represents permeance of the magnetic core 2, $P_{a_in}$ represents permeance inside the electrically conductive layer 1*a*, $P_s$ represents permeance inside the electrically conductive layer 1*a* itself of the film, and $P_{a_out}$ represents permeance outside the electrically conductive layer 1*a*.

Here, it is thought that, when $P_c$ is sufficiently larger than $P_{a_in}$ and $P_s$, the magnetic flux having passed through the inside of the magnetic core 2 and exited the magnetic core 2 through the one end of the magnetic core 2 returns to the other end of the magnetic core 2 through one of $\phi_{a_in}$, $\phi_s$, and $\phi_{a_out}$. Thus, the following relationship (7) holds:

$$\phi\phi=\phi_{a_in}+\phi_s+\phi_{a_out} \quad (7)$$

Also, $\phi_c$, $\phi_s$, $\phi_{a_in}$, and $\phi_{a_out}$ are respectively expressed by the following equations (8) to (11):

$$\phi\phi_c=P_c\times V_m \quad (8)$$

$$\phi\phi_s=P_s\times V_m \quad (9)$$

$$\phi\phi_{a_in}=P_{a_in}\times V_m \quad (10)$$

$$\phi\phi_{a_out}=P_{a_out}\cdot V_m \quad (11).$$

Thus, by substituting equations (8) to (11) to equation (7), $P_{a_out}$ is expressed by, for example, the following equation (12):

$$P_c\times V_m=P_{a_in}\times V_m+P_s\times V_m+P_{a_out}\times V_m$$

$$=(P_{a_in}+P_s+P_{a_out})\times V_m$$

$$\therefore P_{a_out}=P_c-P_{a_in}-P_s \quad (12).$$

From FIG. 7B, when the sectional area of the magnetic core 2 is $S_c$, the sectional area inside the electrically conductive layer 1*a* is $S_{a_in}$, and the sectional area of the electrically conductive layer 1*a* itself is $S_s$, permeance can be expressed by "permeability×sectional area" as follows. In this case, the unit is H·m.

$$P_c=\mu_1\cdot S_c=\mu_1\cdot\pi(a_1)^2 \quad (13)$$

$$P_{a_in}=\mu_0\cdot S_{a_in}=\mu_0\cdot\pi\cdot((a_2)^2-(a_1)^2) \quad (14)$$

$$P_s=\mu_2\cdot S_s=\mu_2\cdot\pi\cdot((a_3)^2-(a_2)^2) \quad (15).$$

By substituting these equations (13) to (15) into equation (12), $P_{a_out}$ can be expressed by equation (16):

$$P_{a_out}=P_c-P_{a_in}-P_s$$

$$=\mu_1\cdot S_c-\mu_0\cdot S_{a_in}-\mu_2\cdot S_s$$

$$=\pi\cdot\mu_1\cdot(a_1)^2$$

$$-\pi\cdot\mu_0\cdot((a_2)^2-(a_1)^2)$$

$$-\pi\cdot\mu_2\cdot((a_3)^2-(a_2)^2) \quad (16)$$

The ratio of the lines of magnetic force $P_{a_out}/P_c$ passing through the outside of the electrically conductive layer 1*a* can be calculated with the above-described equation (16).

Reluctance R may be used instead of permeance P. When discussing with reluctance R, since reluctance R is simply the reciprocal of permeance P, reluctance R per unit length can be expressed by "1/(permeability×sectional are)". In this case, the unit is 1/(H·m).

Results of calculation of permeance and reluctance with specific parameters are listed in Table 1 below.

TABLE 1

| | Unit | Magnetic core | Film guide | Inside electrically conductive layer | Electrically conductive layer | Outside electrically conductive layer |
|---|---|---|---|---|---|---|
| Sectional area | m^2 | 1.5E−04 | 1.0E−04 | 2.0E−04 | 1.5E−06 | |
| Relative permeability | | 1800 | 1 | 1 | 1 | |
| Permeability | H/m | 2.3E−3 | 1.3E−6 | 1.3E−6 | 1.3E−6 | |
| Permeance per unit length | H · m | 3.5E−07 | 1.3E−10 | 2.5E−10 | 1.9E−12 | 3.5E−07 |
| Reluctance per unit length | 1/(H · m) | 2.9E+06 | 8.0E+09 | 4.0E+09 | 5.3E+11 | 2.9E+06 |
| Ratio of magnetic flux | % | 100.0% | 0.0% | 0.1% | 0.0% | 99.9% |

The magnetic core 2 is formed of ferrite (relative permeability is 1800). The diameter and the sectional area of the magnetic core 2 are respectively 14 mm and $1.5\times10^{-4}$ m$^2$. A backup member 9 (film guide), which backs up the fixing film 1 from inside for forming the fixing nip portion N is formed of PPS (relative permeability is 1.0). The sectional area of the backup member 9 is $1.0\times10^{-4}$ m$^2$. The electrically conductive layer 1*a* is formed of aluminum (relative permeability is 1.0). The diameter, the thickness, and the sectional area of the electrically conductive layer 1*a* are respectively 24 mm, 20 μm, and $1.5\times10^{-6}$ m$^2$.

The sectional area of the region between the electrically conductive layer 1*a* and the magnetic core 2 is calculated by subtracting the sectional areas of the magnetic core 2 and the film guide from the sectional area of a hollow inside the electrically conductive layer 1*a* having a diameter of 24 mm. According to Table 1, the values of $P_c$, $P_{a_in}$, and $P_s$ are as follows:

$$P_c=3.5\times10^{-7}H\cdot m$$

$$P_{a_in}=1.3\times10^{-10}+2.5\times10^{-10}H\cdot m$$

$$P_s=1.9\times10^{-12}H\cdot m.$$

With these values, $P_{a_out}/P_c$ can be calculated by using the following equation (17):

$$P_{a_out}/Pc=(P_c-P_{a_in}-P_s)/P_c=0.999(99.9\%) \quad (17).$$

The magnetic core 2 may be divided into a plurality of pieces in the longitudinal direction with gaps formed between the divided pieces of the magnetic core 2. In this case, when the gaps are filled with air, a substance, the relative permeability of which is regarded to be 1.0, or a substance, the relative permeability of which is significantly smaller than that of the magnetic core 2, the reluctance R of the entire magnetic core 2 is increased. This degrades the function of directing the lines of magnetic force.

A calculation method of permeance of such a divided magnetic core 2 is complex. The calculation method of permeance of the entire magnetic core 2 for the following case will be described: that is, the magnetic core 2 is divided into a plurality of pieces, which are arranged at regular intervals with the gaps or sheet-shaped non-magnetic members interposed therebetween. In this case, it is required that reluctance of the entirety in the longitudinal direction be derived, the reluctance be divided by the total length so as to obtain reluctance per unit length, and the reciprocal of the reluctance per unit length be used to obtain permeance per unit length.

Figure 9:
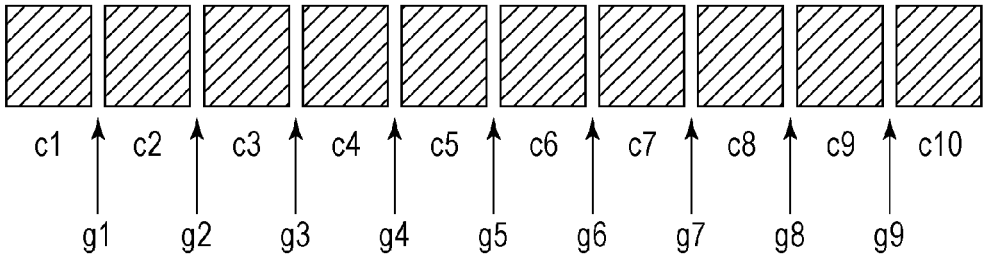
FIG. 9 is a schematic view of magnetic cores and gaps.

Initially, FIG. 9 is a block diagram of a magnetic core in the longitudinal direction. The magnetic core is divided into pieces of the magnetic cores c1 to c10 with gaps g1 to g9 formed therebetween. The sectional area, permeability, and the width of each of the divided pieces of the core are respectively $S_c$, $\mu_c$, and $L_c$. The sectional area, permeability, and the width of each of the gaps g1 to g9 are respectively $S_g$, $\mu_g$, and $L_g$. Total reluctance $R_{m_all}$ of all the pieces of the magnetic core arranged in the longitudinal direction is given by the following equation (18):

$$R_{m_all}=(R_{m_c1}+R_{m_c2}+\ldots+R_{m_c10})+(R_{m_g1}+R_{m_g2}+\ldots+R_{m_g9}) \quad (18).$$

Since the shapes and materials of the pieces of the magnetic core and the gap widths are uniform in this core arrangement, when $\Sigma_{Rm_c}$ is the sum of $R_{m_c}$s and $\Sigma R_{m_g}$ is the sum of $R_{m_g}$s, the relationships expressed by, for example, the following equations (19) to (21) can hold:

$$R_{m_all}=(\Sigma R_{m_c})+(\Sigma R_{m_g}) \quad (19)$$

$$R_{m_c}=L_c/(\mu_c\cdot S_c) \quad (20)$$

$$R_{m_g}=L_g/(\mu_g\cdot S_g) \quad (21).$$

By substituting equations (20) and (21) into equation (19), the total reluctance $R_{m_all}$ in the longitudinal direction can be expressed by, for example, the following equation (22):

$$R_{m_all}=(\Sigma R_{m_c})+(\Sigma R_{m_g})$$

$$=(L_c/(\mu_c\cdot S_c))\times10+(L_g/(\mu_g\cdot S_g))\times9 \quad (22).$$

Here, reluctance $R_m$ per unit length is, when the sum of $L_c$s is $\Sigma L_c$ and the sum of $L_g$s is $\Sigma L_g$, expressed by the following equation (23):

$$R_m=R_{m_all}/(\Sigma L_c+\Sigma L_g)$$

$$=R_{m_all}/(L\times10+L_g\times9) \quad (23).$$

Thus, permeance $P_m$ per unit length can be obtained by the following equation (24):

$$P_m=1/R_m=(\Sigma L_c+\Sigma L_g)/R_{m_all}$$

$$=(\Sigma L_c+\Sigma L_g)/[\{\Sigma L_c/\mu_c+S_c)\}+\{\Sigma L_g/(\mu_g+S_g)\}] \quad (24).$$

An increase in the width of the gap $L_g$ leads to an increase in the reluctance of the magnetic core 2 (reduction in permeance). Regarding the principle of heat generation, in the configuration of the fixing device of the present embodiment, it is desirable that the magnetic core 2 has a low reluctance (high permeance) in the design, and accordingly, the formation of the gaps is less desirable. Despite this, in order to prevent breakage of the magnetic core 2, the magnetic core 2 may be divided into a plurality of pieces with the gaps formed therebetween.

As described above, the ratio of the lines of magnetic force passing through the outside route can be expressed with permeance or reluctance.

(4) Power Conversion Efficiency Required for Fixing Device

Next, power conversion efficiency required for the fixing device of the present embodiment is described. Assuming that power conversion efficiency is, for example, 80%, the remaining 20% of the power is converted into thermal energy and consumed by the coil or core other than the electrically conductive layer. When the power conversion efficiency is low, components not required to generate heat such as a magnetic core and coil generate heat. Thus, a measure to cool these components may be required.

In the present embodiment, when the electrically conductive layer is caused to generate heat, a high-frequency alternating current is caused to flow through the coil to form an alternating magnetic field. This alternating magnetic field induces a current in the electrically conductive layer. The physical model of this is very similar to that of magnetic coupling of a transformer. Thus, when discussing power conversion efficiency, an equivalent circuit of magnetic coupling of the transformer can be used. The coil and the electrically conductive layer are magnetically coupled to each other by the alternating magnetic field, thereby the power input to the coil is transferred to the electrically conductive layer. Herein, "power conversion efficiency" is the ratio of the power consumed by the electrically conductive layer to the power input to the coil serving as a magnetic field forming device. In the present embodiment, power conversion efficiency is the ratio of the power consumed by the electrically conductive layer 1*a* to the power input to the coil 3. This power conversion efficiency can be expressed by the following equation (25):

Power conversion efficiency=power consumed by electrically conductive layer/power supplied to coil (25).

Examples of the power supplied to the coil and consumed by components other than the coil include a loss due to resistance of the coil and a loss due to magnetic characteristics of the material of the magnetic coil.

Figure 10A:
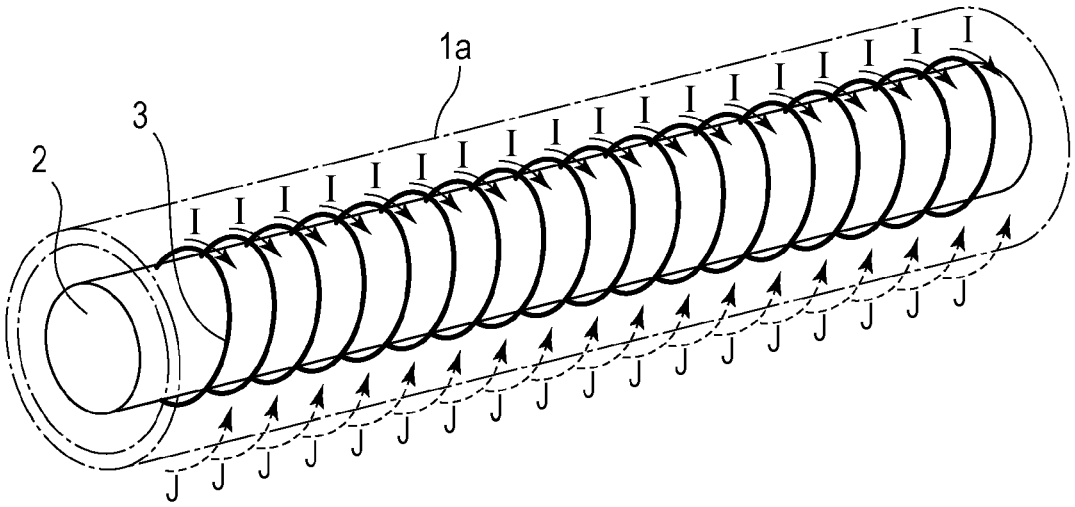
FIGS. 10A and 10B are explanatory views of efficiency of a circuit.
Figure 10B:
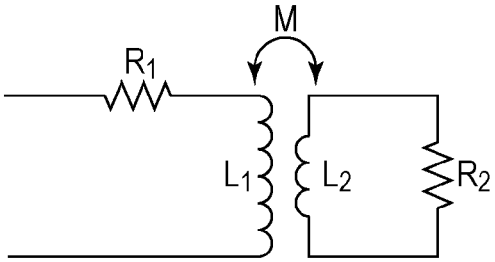

FIGS. 10A and 10B are explanatory views of efficiency of a circuit. In FIG. 10A, the electrically conductive layer 1*a*, the magnetic core 2, and the coil 3 are illustrated. FIG. 10B is an equivalent circuit.

Figure 11A:
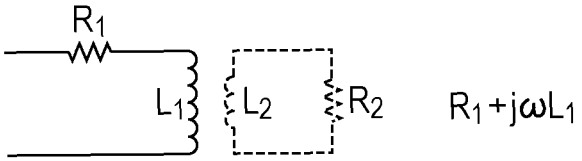
FIGS. 11A to 11C are explanatory views of the efficiency of the circuit.

$R_1$ corresponds to the loss in the coil and the magnetic core, $L_1$ corresponds to the inductance of the coil wound around the magnetic core, M corresponds to the mutual inductance between the winding and the electrically conductive layer, $L_2$ corresponds to the inductance of the electrically conductive layer, and $R_2$ corresponds to the resistance of the electrically conductive layer. An equivalent circuit without the electrically conductive layer is illustrated in FIG. 11A. When an equivalent series resistance $R_1$ from both ends of the coil and equivalent inductance $L_1$ are measured with an impedance analyzer and an inductance/capacitance/resistance meter (LCR meter), the impedance $Z_A$ seen from both the end of the coil can be expressed by, for example, equation (26):

$$Z_A=R_1+j\omega L_1 \quad (26).$$

The current flowing through the circuit is lost by $R_1$. That is, $R_1$ represents the loss caused by the coil and the magnetic core.

Figure 11B:
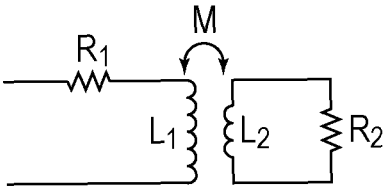
Figure 11C:
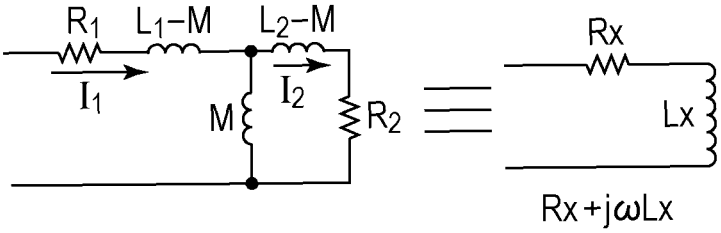
Figure 12:
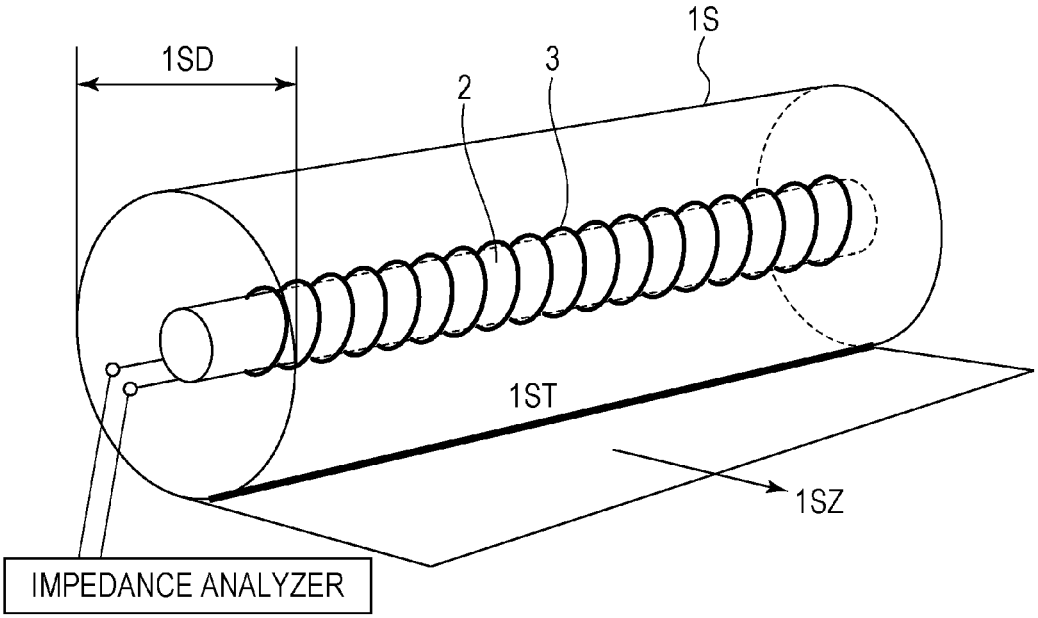
FIG. 12 illustrates an experimental device used in a measurement experiment of power conversion efficiency.

An equivalent circuit with the electrically conductive layer is illustrated in FIG. 11B. By measuring an equivalent series resistance Rx and Lx in this circuit with the electrically conductive layer, relationship (27) can be obtained through equivalent transformation as illustrated in FIG. 11C.

$$\begin{aligned} Z &= R_1 + j\omega(L_1 - M) + \frac{j\omega M(j\omega(L_2 - M) + R_2)}{j\omega M + j\omega(L_2 - M) + R_2} \\ &= R_1 + \frac{\omega^2 M^2 R_2}{R_2^2 + \omega^2 L_2^2} + \\ &\quad j\left(\omega(L_1 - M) + \frac{M \cdot R_2^2 + \omega^2 M L_2 (L_2 - M)}{R_2^2 + \omega^2 L_2^2}\right) \end{aligned} \quad (27)$$

$$Rx = R_1 + \frac{\omega^2 M^2 R_2}{R_2^2 + \omega^2 L_2^2} \quad (28)$$

$$Lx = \omega(L_1 - M) + \frac{M \cdot R_2^2 + \omega^2 M L_2 (L_2 - M)}{R_2^2 + \omega^2 L_2^2}\Bigg) \quad (29)$$

where M is the mutual inductance between the coil and the electrically conductive layer.

As illustrated in FIG. 11C, when $I_1$ represents a current flowing through $R_1$ and $I_2$ represents a current flowing through $R_2$, equation (30) holds.

$$j\omega M(I_1-I_2)=(R_2+j\omega(L_2-M))I_2 \quad (30).$$

Expression (31) can be derived from equation (30).

$$I_1 = \frac{R_2 + j\omega L_2}{j\omega M} I_2. \quad (31)$$

Efficiency (power conversion efficiency), which can be expressed as power consumption by resistance $R_2$/(power consumption by resistance $R_1$+power consumption by resistance $R_2$), can be expressed by, for example, equation (32):

$$\begin{aligned} \text{Power conversion efficiency} &= \frac{R_2 \times |I_2^2|}{R_1 \times |I_1^2| + R_2 \times |I_2^2|} \\ &= \frac{\omega^2 M^2 R_2}{\omega^2 L_2^2 R_1 + R_1 R_2^2 + \omega^2 M^2 R_2} \\ &= \frac{Rx - R_1}{Rx}. \end{aligned} \quad (32)$$

By measuring the equivalent series resistance $R_1$ without the electrically conductive layer and the equivalent series resistance Rx with the electrically conductive layer, power conversion efficiency, which represents the ratio of power consumed by the electrically conductive layer to the power supplied to the coil, can be obtained. In the present embodiment, the impedance analyzer 4294A from Agilent Technologies, Inc. is used for measurement of power conversion efficiency. Initially, the equivalent series resistance $R_1$ from both the ends of winding is measured without the fixing film. Then, the equivalent series resistance Rx from both the ends of winding is measured with the magnetic core inserted into the fixing film. As a result of the measurement, $R_1$=103 mΩ, and Rx=2.2Ω. With equation (32), power conversion efficiency at this time, 95.3%, can be obtained. Hereafter, the performance of the fixing device is evaluated in accordance with this power conversion efficiency.

Here, power conversion efficiency required for the device is obtained. The power conversion efficiency is evaluated with respect to the ratio of the magnetic flux passing through the outside route of the electrically conductive layer 1*a*. FIG.

12 illustrates an experimental device used in a measurement experiment of power conversion efficiency. A metal sheet 1S is an aluminum sheet having a width of 230 mm, a length of 600 mm, and a thickness of 20 μm. The metal sheet 1S is rolled into a cylindrical shape so as to surround the magnetic core 2 and the coil 3. Electrical conduction is made at a portion represented by a bold line 1ST so that the metal sheet 1S serves as an electrically conductive layer. The magnetic core 2 having a columnar shape is formed of ferrite. The relative permeability and saturation flux density of the magnetic core 2 are respectively 1800 and 500 mT. The magnetic core 2 has a sectional area of 26 $mm^2$ and the length of 230 mm. The magnetic core 2 is disposed at the substantial center of the cylinder formed of the aluminum sheet 1S with a securing device (not illustrated). The coil 3 is spirally wound 25 turns around the magnetic core 2. By pulling an end portion of the metal sheet 1S in an arrow 1SZ direction, a diameter 1SD of the electrically conductive layer can be adjusted within a range of 18 to 191 mm.

Figure 13:
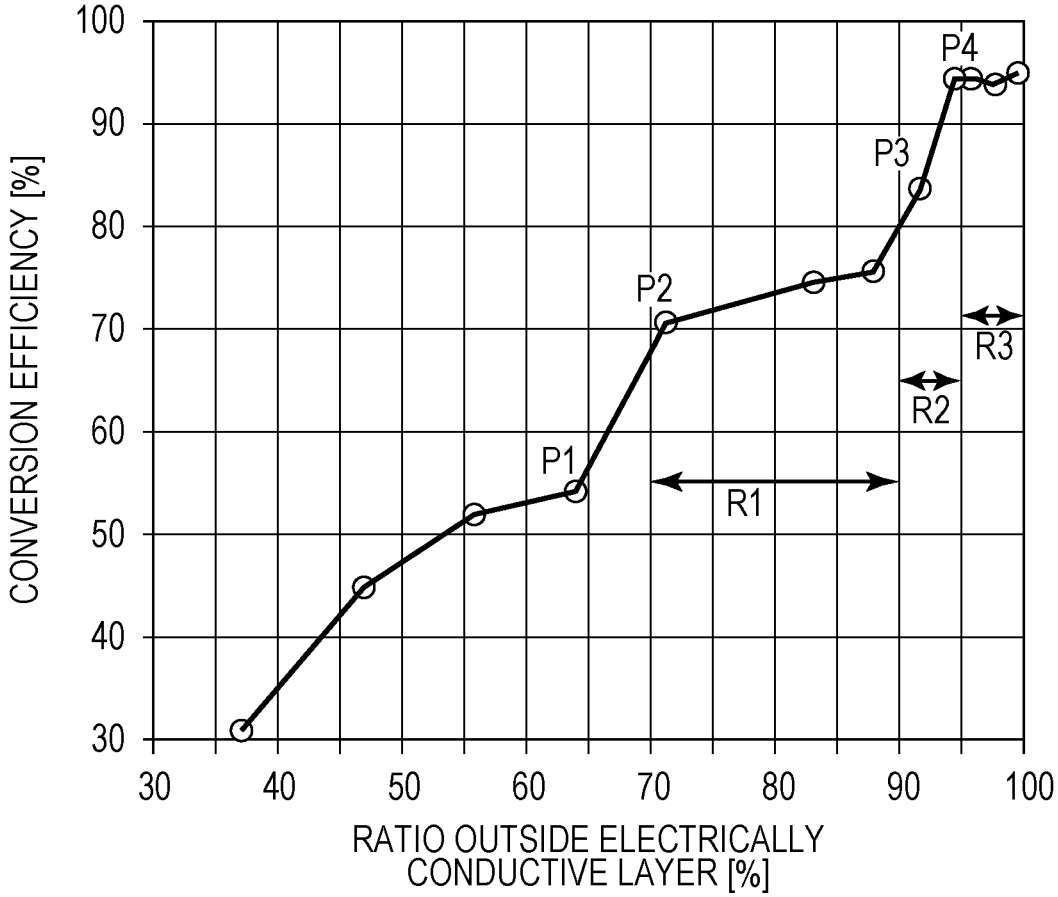
FIG. 13 illustrates the relationship between the ratio of the magnetic flux outside an electrically conductive rotating member and conversion efficiency.

FIG. 13 is a graph in which the horizontal axis represents the ratio in % of the magnetic flux passing through the outside route of the electrically conductive layer, and the vertical axis represents power conversion efficiency at the frequency of 21 kHz.

Referring to the graph in FIG. 13, the power conversion efficiency steeply increases from point P1 to a value more than 70%. In a range R1 indicated by a double-headed arrow, the power conversion efficiency is maintained at 70% or more. From a point near point P3, the power conversion efficiency steeply increases again and reaches to a value equal to or more than 80% in range R2. In a range R3 after P4, the power conversion efficiency is stabilized at a high value equal to or more than 94%. This steep increase in power conversion efficiency is caused due to starting of efficient flow of the circulating current in the electrically conductive layer.

Table 2 below lists results, which are obtained by actually designing configurations corresponding to P1 to P4 in FIG. 13 as the fixing device and evaluated.

TABLE 2

| No. | Range | Diameter of electrically conductive layer (in mm) | Ratio of magnetic flux passing outside electrically conductive layer | Conversion efficiency [%] | Evaluation result (for high-performance fixing device) |
|---|---|---|---|---|---|
| P1 | — | 143.2 | 64.0 | 54.4 | Power may be insufficient. |
| P2 | R1 | 127.3 | 71.2 | 70.8 | Cooling device is desired. |
| P3 | R2 | 63.7 | 91.7 | 83.9 | Optimization of heat resistant design is desired. |
| P4 | R3 | 47.7 | 94.7 | 94.7 | Optimum configuration for flexible film. |

Fixing Device P1

In this configuration, the sectional area of the magnetic core is 26.5 $mm^2$ (5.75 mm×4.5 mm), the diameter of the electrically conductive layer is 143.2 mm, and the ratio of the magnetic flux passing through the outside route is 64%. Power conversion efficiency of this device obtained with the impedance analyzer is 54.4%. Power conversion efficiency is a parameter representing the ratio of the power contributing to heat generation by the electrically conductive layer to the power input to the fixing device. Thus, even when the fixing device is designed as a device that can output power of 1000 W at the maximum, about 450 W is lost. This loss is used for heat generation by the coil and the magnetic core.

In this configuration, when the fixing device is started up, the coil temperature may exceed 200° C. when power of 1000 W is input even for a several seconds. Considering that the heatproof temperature of the insulating material of the coil is about 250 to 300° C., and the Curie temperature of the magnetic core formed of ferrite is typically from about 200 to 250° C., it is unlikely that the temperatures of the components such as a coil are maintained at equal to or lower than the heatproof temperature when 45% of the power is lost. Furthermore, when the temperature of the magnetic core exceeds the Curie temperature, the inductance of the coil steeply reduces, thereby causing variation of the load.

Since about 45% of the power supplied to the fixing device is not used for heat generation by the electrically conductive layer, in order to supply power of 900 W (assuming 90% of 1000 W) to the electrically conductive layer, about 1636 W is required to be supplied. This means a power source that consumes 16.36 A when 100 V is input. This may exceed the allowable current able to be input through an attachment plug for commercial alternating current. Thus, with the fixing device P1 of power conversion efficiency of 54.4%, power supplied to the fixing device may be insufficient.

Fixing Device P2

In this configuration, the sectional area of the magnetic core is the same as that of P1, the diameter of the electrically conductive layer is 127.3 mm, and the ratio of the magnetic flux passing through the outside route is 71.2%. Power conversion efficiency of this device obtained with the impedance analyzer is 70.8%. An increase in temperature of the coil and the core may cause a problem depending on the performance of the fixing device. When the fixing device of this configuration is a high-performance device that can print 60 sheets per minute, the rotation speed of the electrically conductive layer is 330 mm/sec and the temperature of the electrically conductive layer is required to be maintained at 180° C. In order to maintain the temperature of the electrically conductive layer at 180° C., the temperature of the magnetic core may exceed 240° C. in 20 seconds. Since the Curie temperature of the ferrite used for the magnetic core is typically about 200 to 250° C., the temperature of the ferrite may exceed the Curie temperature, resulting in steep reduction in the permeability of the magnetic core. This may lead to a situation in which the magnetic core cannot appropriately direct the lines of magnetic force. As a result, it is unlikely in some cases that the circulating current is guided so as to cause the electrically conductive layer to generate heat.

Thus, it is desirable that the fixing device, in which the ratio of the magnetic flux passing through the outside route is within the range R1, be provided with a cooling device that reduces the temperature of the ferrite core when the fixing device is the above-described high-performance device. Examples of the cooling device can include a cooling fan, a water cooling device, a heat dissipating plate, a heat dissipating fin, a heat pipe, and a Peltier device. Of course, when such high performance is not required for this configuration, the cooling device is not required.

Fixing Device P3

In this configuration, the sectional area of the magnetic core is the same as that of P1 and the diameter of the electrically conductive layer is 63.7 mm. Power conversion efficiency of this device obtained with the impedance analyzer is 83.9%. Although heat is constantly generated in the components such as the magnetic core and the coil, the degree of heat generation in this device is such that the cooling device is not required. When the fixing device of this configuration is a high-performance device that can print 60 sheets/minute, the rotation speed of the electrically conductive layer is 330 mm/sec and the surface temperature of the electrically conductive layer may be maintained at 180° C. Despite this, the temperature of the magnetic core (ferrite) does not increase to equal to or higher than 220° C. Thus, in this configuration, when the fixing device is the above-described high-performance device, it is desirable that a ferrite, the Curie temperature of which is equal to or higher than 220° C., be used.

Thus, when the fixing device, which is configured such that the ratio of the magnetic flux passing through the outside route is in the range R2, is used as the high-performance device, it is desirable that the heat resistant design of ferrite or the like be optimized. When high performance is not required for the fixing device, such heat resistant design is not required.

Fixing Device P4

In this configuration, the sectional area of the magnetic core is the same as that of P1 and the diameter of a cylindrical body is 47.7 mm. Power conversion efficiency of this device obtained with the impedance analyzer is 94.7%. Even when the fixing device of this configuration is the high-performance device that can print 60 sheets/minute (the rotation speed of the electrically conductive layer is 330 mm/sec), and the surface temperature of the electrically conductive layer is maintained at 180° C., the temperatures of the components such as the magnetic core and the coil do not reach a temperature equal to or higher than 180° C. Thus, neither the cooling device that cools the components such as the magnetic core and the coil nor a particular heat resistant design is required.

Thus, in the range R3, where the ratio of the magnetic flux passing through the outside route is equal to or more than 94.7%, power conversion efficiency becomes equal to or more than 94.7%. Thus, power conversion efficiency is sufficiently high. Thus, the cooling device is not required even when the fixing device is used as the high-performance fixing device.

Furthermore, in the range R3 where power conversion efficiency is stabilized at a high value, even when the amount per unit time of the magnetic flux passing through the inside of the electrically conductive layer slightly varies due to variation of the positional relationship between the electrically conductive layer and the magnetic core, the amount of variation of power conversion efficiency is small, and accordingly, the amount of heat generated by the electrically conductive layer is stable. When the fixing device uses a flexible film or the like, the distance between the electrically conductive layer and the magnetic core is likely to vary. In this case, the range R3 where power conversion efficiency is stabilized at a high value is very useful.

Thus, it can be understood that, in order to satisfy at least a required power conversion efficiency, it is required that the ratio of the magnetic flux passing through the outside route be equal to or more than 72% in the fixing device of the present embodiment (although the ratio is equal to or more than 71.2% according to Table 2, it is assumed to be equal to or more than 72% with consideration of measurement errors or the like).

(5) Relationship of Permeance or Reluctance to be Satisfied by Device

A state in which the ratio of the magnetic flux passing through the outside route of the electrically conductive layer is equal to or more than 72% is equivalent to a state in which the sum of the permeance of the electrically conductive layer and the permeance inside the electrically conductive layer (region between the electrically conductive layer and the magnetic core) is equal to or less than 28% of the permeance of magnetic core. Thus, one of the characteristic configurations of the present embodiment is that, when the permeance of the magnetic core is $P_c$, the permeance inside the electrically conductive layer is $P_a$, and the permeance of the electrically conductive layer is $P_s$, the following equation (33) is satisfied:

$$0.28\times P_c \geq P_s + P_a \quad (33).$$

When permeance is replaced with reluctance in the relationship of the permeance, the following equation (34) is obtained:

$$\begin{aligned} 0.28\times P_c &\geq P_s + P_a \\ 0.28\times \frac{1}{R_c} &\geq \frac{1}{R_s} + \frac{1}{R_a} \\ 0.28\times \frac{1}{R_c} &\geq \frac{1}{R_{sa}} \\ 0.28\times R_{sa} &\geq R_c. \end{aligned} \quad (34)$$

The combined reluctance $R_{sa}$ of $R_s$ and $R_a$ is calculated as expressed by the following equation (35):

$$\begin{aligned} \frac{1}{R_{sa}} &= \frac{1}{R_s} + \frac{1}{R_a} \\ R_{sa} &= \frac{R_a \times R_s}{R_a + R_s} \end{aligned} \quad (35)$$

where $R_c$ is the reluctance of the magnetic core, $R_s$ is the reluctance of the electrically conductive layer, $R_a$ is the reluctance of the region between the electrically conductive layer and the magnetic core, and $R_{sa}$ is the combined reluctance of $R_s$ and $R_a$.

The above-described relationship of permeance or reluctance can be satisfied in a section perpendicular to the generatrix direction of the cylindrical rotating member in the entirety of a maximum recording medium conveying region in the fixing device.

Likewise, in the fixing device for range R2 of the present embodiment, the ratio of the magnetic flux passing through the outside route of the electrically conductive layer is equal to or more than 92% (although the ratio is equal to or more than 91.7% according to Table 2, the ratio is assumed to be equal to or more than 92% with consideration for measurement errors or the like). A state in which the ratio of the magnetic flux passing through the outside route of the electrically conductive layer is equal to or more than 92% is equivalent to a state in which the sum of the permeance of the electrically conductive layer and the permeance inside the electrically conductive layer (region between the electrically conductive layer and the magnetic core) is equal to or less than 8% of the permeance of magnetic core. The relationship of permeance is expressed in the following equation (36):

$$0.08\times P_c \geq P_s + P_a \quad (36).$$

When the above-described relationship of permeance is converted into a relationship of reluctance, it is expressed in the following equation (37):

$$0.08\times P_c \geq P_s + P_a$$

$$0.08\times R_{sa} \geq R_c \quad (37).$$

Furthermore, in the fixing device for range R3 of the present embodiment, the ratio of the magnetic flux passing through the outside route of the electrically conductive layer is equal to or more than 95% (although the ratio is exactly equal to or more than 94.7% according to Table 2, the ratio is assumed to be equal to or more than 95% with consideration of measurement errors or the like). The relationship of permeance is expressed in equation (38) below. A state in which the ratio of the magnetic flux passing through the outside route of the electrically conductive layer is equal to or more than 95% is equivalent to a state in which the sum of the permeance of the electrically conductive layer and the permeance inside the electrically conductive layer (region between the electrically conductive layer and the magnetic core) is equal to or less than 5% of the permeance of magnetic core. The relationship of permeance is expressed in the following equation (38):

$$0.05\times P_c \geq P_s + P_a \quad (38).$$

When the above-described relationship expressed in equation (38) of permeance is converted into a relationship of reluctance, it is expressed in the following equation (39):

$$0.05\times P_c \geq P_s + P_a$$

$$0.05\times R_{sa} \geq R_c \quad (39).$$

The relationships of permeance and reluctance have been described for the fixing device, in which the components and the like have a uniform sectional structure in the longitudinal direction in the maximum image region of the fixing device. Hereafter, a fixing device, in which the components included in the fixing device have a non-uniform sectional structure in the longitudinal direction, will be described. Referring to FIG. 14, a temperature detecting member 240 is provided inside the electrically conductive layer (region between the magnetic core and the electrically conductive layer). The fixing device includes the film 1, which includes the electrically conductive layer, the magnetic core 2, and the backup member (film guide) 9.

When the longitudinal direction of the magnetic core 2 is defined as the X direction, a maximum image forming region is from 0 to Lp on the X axis. For example, in the case of an image forming device in which the maximum recording medium conveying range is 215.9 mm for a letter (LTR) size, Lp can be set to 215.9 mm. The temperature detecting member 240 includes a non-magnetic member, the relative magnetic permeability of which is 1. The sectional area of the temperature detecting member 240 is 5 mm×5 mm in a direction perpendicular to the X axis, and the length of the temperature detecting member 240 in a direction parallel to the X axis is 10 mm. The temperature detecting member 240 is disposed in a range from L1 (102.95 mm) to L2 (112.95 mm) on the X axis. Here, a range from 0 to L1 on the X axis is referred to as range 1, a range from L1 to L2, in which the temperature detecting member 240 is disposed, is referred to as range 2, and a range from L2 to LP is referred to as range 3. The sectional structure in range 1 is illustrated in FIG. 15A and the sectional structure in range 2 is illustrated in FIG. 15B. As illustrated in FIG. 15B, the temperature detecting member 240, which is contained in the film 1, is included in magnetic reluctance calculation. In order to exactly perform the magnetic reluctance calculation, "reluctances per unit lengths" are separately obtained for ranges 1 to 3 and integrated in accordance with the lengths of ranges 1 to 3. The results are summed to obtain a combined reluctance. Initially, the reluctances per unit length of the components in ranges 1 to 3 are listed in Table 3 below.

TABLE 3

| Parameter | Unit | Magnetic core | Film guide | Inside electrically conductive layer | Electrically conductive layer |
|---|---|---|---|---|---|
| Sectional area | m^2 | 1.5E−04 | 1.0E−04 | 2.0E−04 | 1.5E−06 |
| Relative permeability | | 1800 | 1 | 1 | 1 |
| Permeability | H/m | 2.3E−03 | 1.3E−06 | 1.3E−06 | 1.3E−06 |
| Permeance per unit length | H · m | 3.5E−07 | 1.3E−10 | 2.5E−10 | 1.9E−12 |
| Reluctance per unit length | 1/(H · m) | 2.9E+06 | 8.0E+09 | 4.0E+09 | 5.3E+11 |

The reluctance per unit length $r_{c1}$ of the magnetic core in range 1 is as follows: $r_c1=2.9\times10^6$ [(1/(H·m)].

Here, the reluctance per unit length $r_a$ of the region between the electrically conductive layer and the magnetic core is a combined reluctance of the reluctance per unit length $r_f$ of the film guide and the reluctance per unit length $r_{air}$ of the inside of the electrically conductive layer. Thus, the following equation (40) can be used for the calculation:

$$\frac{1}{r_a} = \frac{1}{r_f} + \frac{1}{r_{air}}. \quad (40)$$

As a result of the calculation, the reluctance $r_a1$ in range 1 and the reluctance $r_s1$ in range 1 are as follows:

$$r_a1=2.7\times10^9[1/(H\cdot m)]$$

$$r_s1=5.3\times10^{11}[1/(H\cdot m)].$$

Since range 3 is the same as range 1, the reluctances in range 3 are as follows:

$$r_c3=2.9\times10^6[(1/(H\cdot m)]$$

$r_a3=2.7\times10^9[1/(H\cdot m)]$ $r_s3=5.3\times10^{11}[1/(H\cdot m)]$.

Next, the reluctances per unit length of the components in range 2 are listed in Table 4 below.

TABLE 4

| Parameter | Unit | Magnetic core c | Film guide | Thermistor | Inside electrically conductive layer | Electrically conductive layer |
|---|---|---|---|---|---|---|
| Sectional area | m^2 | 1.5E−04 | 1.0E−04 | 2.5E−05 | 1.72E−04 | 1.5E−06 |
| Relative permeability | | 1800 | 1 | 1 | 1 | 1 |
| Permeability | H/m | 2.3E−03 | 1.3E−06 | 1.3E−06 | 1.3E−06 | 1.3E−06 |
| Permeance per unit length | H · m | 3.5E−07 | 1.3E−10 | 3.1E−11 | 2.2E−10 | 1.9E−12 |
| Reluctance per unit length | 1/(H · m) | 2.9E+06 | 8.0E+09 | 3.2E+10 | 4.6E+09 | 5.3E+11 |

The reluctance per unit length $r_c2$ of the magnetic core in range 2 is as follows: $r_c2=2.9\times10^6$ [(1/(H·m)].

The reluctance per unit length $r_a$ of the region between the electrically conductive layer and the magnetic core is a combined reluctance of the reluctance per unit length $r_f$ of the film guide, the reluctance per unit length $r_t$ of the thermistor, and the reluctance per unit length $r_{air}$ of the air inside the electrically conductive layer. Thus, the following equation (41) can be used for the calculation:

$$\frac{1}{r_a} = \frac{1}{r_t} + \frac{1}{r_f} + \frac{1}{r_{air}}. \tag{41}$$

As a result of the calculation, the reluctance per unit length $r_a2$ and the reluctance per unit length $r_c2$ in range 2 are as follows:

$r_a2=2.7\times10^9[1/(H\cdot m)]$ $r_s2=5.3\times10^{11}[1/(H\cdot m)]$.

The calculation method for range 3 is the same as that for range 1 and description thereof is omitted.

The reluctances per unit length $r_a$ in the region between the electrically conductive layer and the magnetic core are $r_a1=r_a2=r_a3$. The reason for this is described as follows. That is, in the reluctance calculation for range 2, the sectional area of the thermistor 240 is increased and the sectional area of the air inside the electrically conductive layer is reduced. However, since the relative permeabilities of both the thermistor 240 and the air are 1, the reluctances are the same with or without the thermistor 240. That is, in the case where only a non-magnetic material is disposed in the region between the electrically conductive layer and the magnetic core, reluctance can be sufficiently accurately calculated even when the non-magnetic material is treated similarly to the air. The reason for this is that the relative permeability of the non-magnetic material is substantially 1. In contrast, in the case of a magnetic material (nickel, steel, silicon steel, or the like), reluctance for a region where the magnetic material is disposed can be calculated separately from that for other regions.

Regarding the reluctance R [A/Wb(1/H)] as a combined reluctance in the generatrix direction of the electrically conductive layer, the integrals can be calculated from the reluctances r1, r2, and r3 [1/(H·m)] of the regions as expressed by the following equation (42):

$$\begin{aligned} R &= \int_0^{L1} r1\,dl1 + \int_{L1}^{L2} r2\,dl1 + \int_{L2}^{Lp} r3\,dl1 \\ &= r1(L1-0) + r2(L2-L1) + r3(LP-L2). \end{aligned} \tag{42}$$

Thus, the reluctance $R_c$ [H] of the core in an interval from one end to the other end of the maximum recording medium conveying range can be calculated as expressed in the following equation (43):

$$\begin{aligned} R_c &= \int_0^{L1} r_c1\,dl1 + \int_{L1}^{L2} r_c2\,dl1 + \int_{L2}^{Lp} r_c3\,dl1 \\ &= r_c1(L1-0) + r_c2(L2-L1) + r_c3(LP-L2). \end{aligned} \tag{43}$$

Also, the combined reluctance $R_a$ [H] of the region between the electrically conductive layer and the magnetic core in the interval from the one end to the other end of the maximum recording medium conveying range can be calculated as expressed in the following equation (44):

$$\begin{aligned} R_a &= \int_0^{L1} r_a1\,dl1 + \int_{L1}^{L2} r_a2\,dl1 + \int_{L2}^{Lp} r_a3\,dl1 \\ &= r_a1(L1-0) + r_a2(L2-L1) + r_a3(LP-L2). \end{aligned} \tag{44}$$

The combined reluctance $R_s$ [H] of the electrically conductive layer in the interval from the one end to the other end of the maximum recording medium conveying range is as expressed in the following equation (45):

$$\begin{aligned} R_s &= \int_0^{L1} r_s1\,dl1 + \int_{L1}^{L2} r_s2\,dl1 + \int_{L2}^{Lp} r_s3\,dl1 \\ &= r_s1(L1-0) + r_s2(L2-L1) + r_s3(LP-L2). \end{aligned} \tag{45}$$

Table 5 below lists the results of the above-described calculations for each of the ranges:

TABLE 5

| | Range 1 | Range 2 | Range 3 | Combined reluctance |
|---|---|---|---|---|
| Integration start point (in mm) | 0 | 102.95 | 112.95 | |
| Integration end point (in mm) | 102.95 | 112.95 | 215.9 | |
| Distance (in mm) | 102.95 | 10 | 102.95 | |
| Permeance $p_c$ per unit length [H · m] | 3.5E−07 | 3.5E−07 | 3.5E−07 | |
| Reluctance $r_c$ per unit length [1/(H · m)] | 2.9E+06 | 2.9E+06 | 2.9E+06 | |
| Integration of reluctance $r_c$ [A/Wb(1/H)] | 3.0E+08 | 2.9E+07 | 3.0E+08 | 6.2E+08 |
| Permeance $p_a$ per unit length [H · m] | 3.7E−10 | 3.7E−10 | 3.7E−10 | |
| Reluctance $r_a$ per unit length [1/(H · m)] | 2.7E+09 | 2.7E+09 | 2.7E+09 | |
| Integration of reluctance $r_a$ [A/Wb(1/H)] | 2.8E+11 | 2.7E+10 | 2.8E+11 | 5.8E+11 |
| Permeance $p_s$ per unit length [H · m] | 1.9E−12 | 1.9E−12 | 1.9E−12 | |
| Reluctance $r_s$ per unit length [1/(H · m)] | 5.3E+11 | 5.3E+11 | 5.3E+11 | |
| Integration of reluctance $r_s$ [A/Wb(1/H)] | 5.4E+13 | 5.3E+12 | 5.4E+13 | 1.1E+14 |

According to Table 5 above, $R_c$, $R_a$, and $R_s$ are as follows:

$$R_c=6.2\times10^8[1/H]$$

$$R_a=5.8\times10^{11}[1/H]$$

$$R_s=1.1\times10^{14}[1/H].$$

The combined reluctance $R_{sa}$ of $R_s$ and $R_a$ can be calculated by the following equation (46):

$$\frac{1}{R_{sa}}=\frac{1}{R_s}+\frac{1}{R_a} \tag{46}$$

$$R_{sa}=\frac{R_a\times R_s}{R_a+R_s}.$$

From the above-described calculation, $R_{sa}=5.8\times10^{11}$ [1/H], which satisfies the following equation (47):

$$0.28\times R_{sa}\geq R_c \tag{47}.$$

Thus, for the fixing device including the electrically conductive layer having a non-uniform cross-sectional shape in the generatrix direction of the electrically conductive layer, a plurality of ranges are defined in the generatrix direction of the electrically conductive layer and reluctance is calculated for each of the ranges. Then, at last, permeance or reluctance may be calculated by combining permeances or reluctances of the ranges. However, when an objective component is formed of a non-magnetic material, since the permeability of a non-magnetic material is substantially equal to that of the air, the non-magnetic component may be regarded as the air in the calculation. Next, components to be included in the above-described calculation are described. The permeance or reluctance of a component can be included in the calculation when the component is disposed in the region between the electrically conductive layer and the magnetic core, and at least part of the component is disposed within the maximum recording medium conveying range (0 to Lp). In contrast, it is not required that the permeance or the reluctance of a component disposed outside the electrically conductive layer be calculated. The reason for this is that, as described above, according to Faraday's law, an induced electromotive force is proportional to time variation of a magnetic flux that perpendicularly penetrates through a circuit and not related to a magnetic flux outside the electrically conductive layer. Furthermore, heat generation by the electrically conductive layer is not affected by the component disposed outside the maximum recording medium conveying range in the generatrix direction of the electrically conductive layer. Thus, calculation for such a component is not required.

As described above, it is required that the conditions for the fixing device, in which the induced current flowing in the circumferential direction of the rotating member can be increased (heat generation efficiency can be improved) with the core having the ends, satisfy at least equation (33).

Next, the fixing device according to the second embodiment is described with reference to FIG. 16. As illustrated in FIG. 16, the difference in the fixing device between the first embodiment and the second embodiment is that the core 213 of the second embodiment has ends. The pitch of the winding of the coil 212 spirally wound around the core 213 is uniform. The length of the spirally shaped portion of the coil 212 is larger than the length of the film 214. In other word, the magnetic member 213 has the ends and does not form a loop. In addition, with respect to the generatrix direction of the rotating member 214, the magnetic member 213 and the spirally shaped portion of the coil 212 have the lengths, with which the magnetic member 213 and the spirally shaped portion extend beyond both the end portions of the rotating member 214.

Figure 17A:
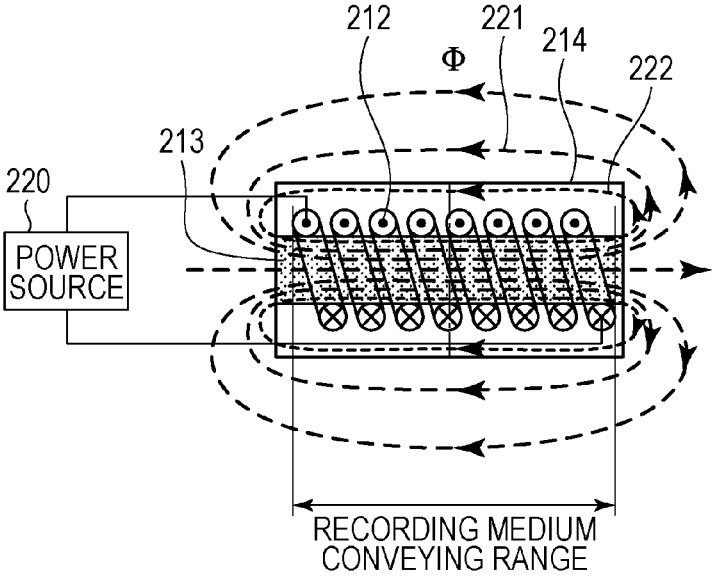
FIGS. 17A and 17B explain magnetic fluxes formed by the fixing device according to the second embodiment.
Figure 17B:
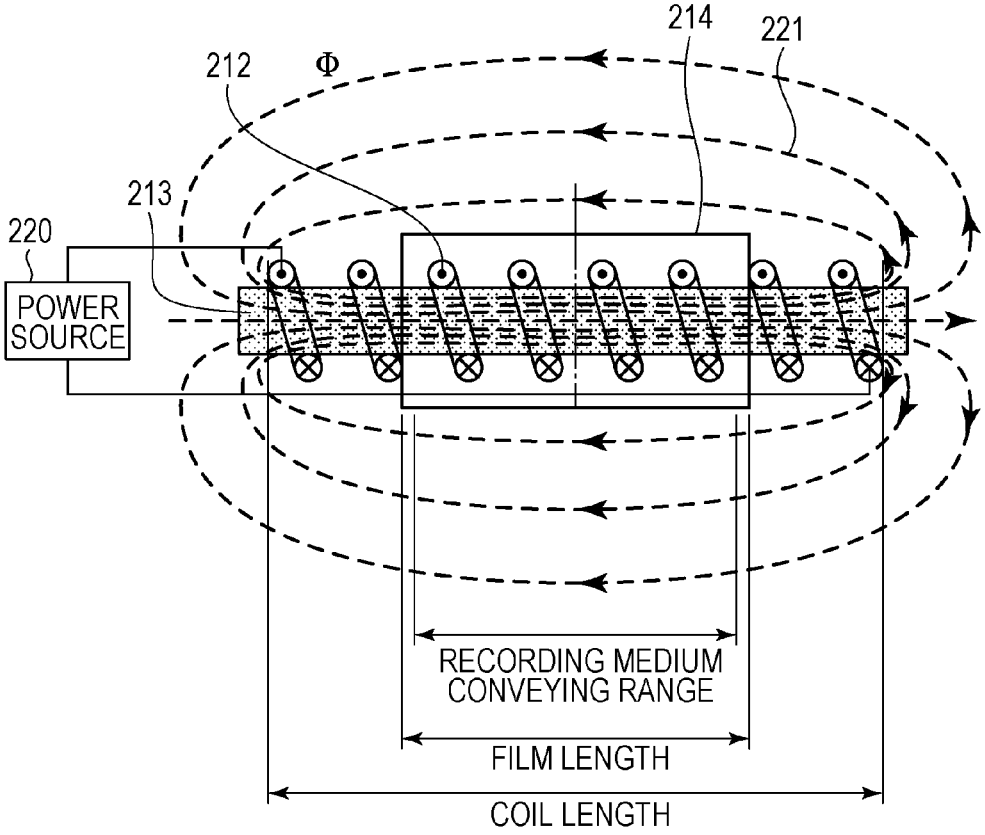

FIG. 17A illustrates a third comparative example. When the core 213 has the ends as illustrated in FIG. 17A, out of the magnetic fluxes 221 and 222 exiting the core 213 through the end portion of the core 213, components of the magnetic fluxes 221 and 222 spreading perpendicular to the surface of the film 214 increase due to the difference in permeability between the core 213 and the outside of the core 213. The degrees of spreading of the components of the magnetic fluxes 221 and 222 perpendicular to the film 214 are calculated by multiplying the following: permeability of core 213/permeability of magnetic flux in vacuum. The magnetic flux 221 passes through a space outside the film 214 and enters the core 213 through the other end portion of the core 213. The magnetic flux 222 not contributing to heat generation passes through a space between the film 214 and the coil 212 and enters the core 213 through the other end portion of the core 213.

In contrast, in the case where the lengths of the coil 212 and the core 213 are larger than that of the film 214 as in the present embodiment illustrated in FIG. 17B, components of the magnetic fluxes 221 and 222 perpendicular to the film 214 outside the film 214 spread more than those in the case illustrated in FIG. 17A. Accordingly, part of the magnetic flux 222 illustrated in FIG. 17A is replaced with the magnetic flux 221 passing through the outside of the film 214 in FIG. 17B, thereby improving heat generation efficiency. When the core has the ends and has an open loop configuration, the magnetic flux 222 passing through the inside of the cylinder of the film 214 increases compared to the closed loop configuration using the annular core. However, when the core and the coil extend to the outside of the cylinder of the film as in the present embodiment, reduction in the heat generation efficiency can be suppressed.

Third Embodiment

Figure 18:
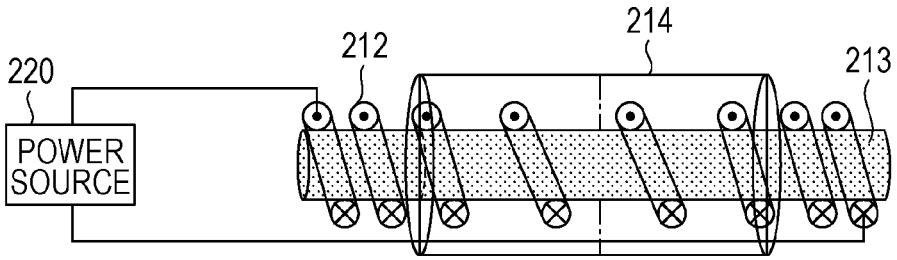
FIG. 18 illustrates a configuration of a coil and core in a fixing device according to a third embodiment.
Figure 19:
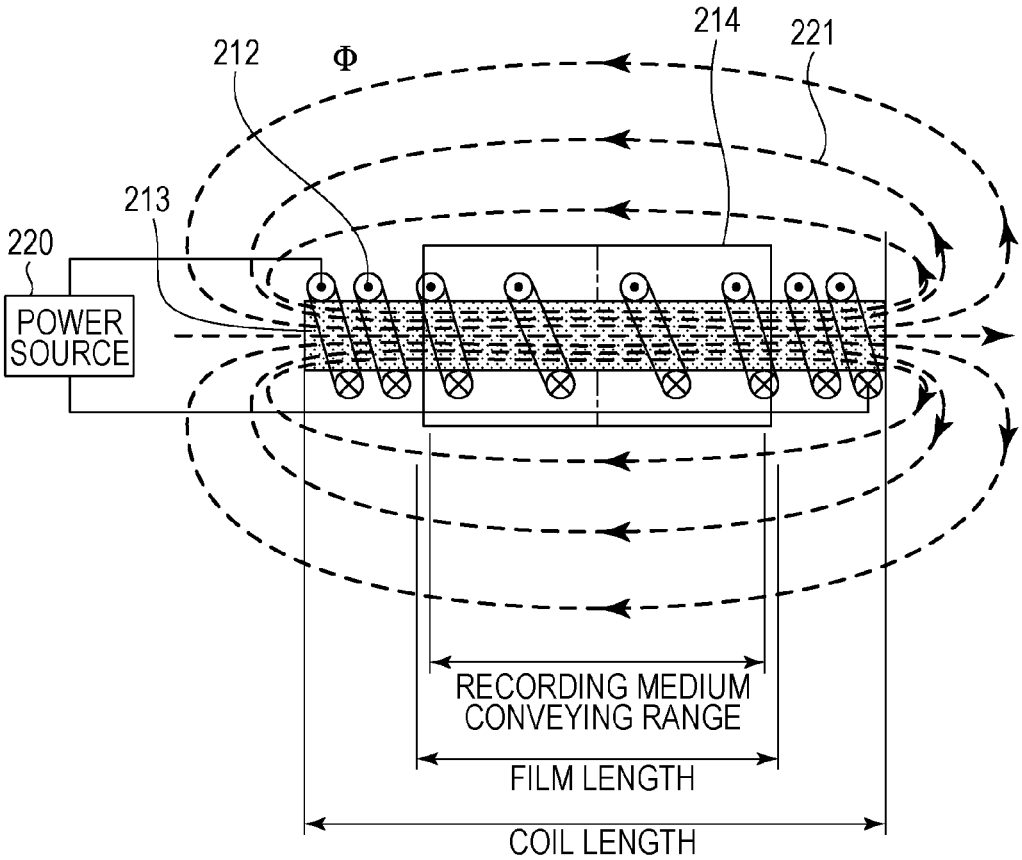
FIG. 19 explains magnetic fluxes formed by the fixing device according to the third embodiment.

Next, a third embodiment is described with reference to FIGS. 18 and 19. The difference between the second embodiment and the third embodiment is that, in the third embodiment, the pitch of the winding of the coil 212 is smaller at both end portions of the spirally shaped portion than in a central portion of the spirally shaped portion as illustrated in FIGS. 18 and 19.

Defining that the radius of the coil 212 is r, the length of the coil 212 is 1, the permeability of the core 213 is μ, a current flowing through the coil 212 is I(t), and the center of the coil 212 is z=0. Furthermore, the number of turns per unit length is varied from position z to position z. Thus, the number of turns per unit length can be expressed as the function of z, that is, n(z) here. In this case, the magnetic field strength H(z) at the center of the core 213 at an arbitrary position z is expressed by equation (48) as follows:

$$H(z) = \frac{I(t)}{2} * \int_{\frac{1}{2}}^{\frac{1}{2}} n(2) * \left( \frac{z+\frac{1}{2}}{\sqrt{r^2+\left(z+\frac{1}{2}\right)^2}} - \frac{z-\frac{1}{2}}{\sqrt{r^2+\left(z-\frac{1}{2}\right)^2}} \right) dz. \tag{48}$$

Furthermore, the magnetic flux Φ(z) inside the coil 212 at the arbitrary position z is given by Φ(z)=μH(z)·2πr^2. When the permeability μ of the core 213 is sufficiently larger than that in vacuum, an electromotive force V(z) generated in the film 214 at the arbitrary position z is mainly affected by the magnetic flux inside the coil 212 and can be expressed by equation (49) as follows:

$$V(z) = -\mu * (2\pi r^2) * \frac{1}{2} * \frac{dI(t)}{dt} * \int_{\frac{1}{2}}^{\frac{1}{2}} n(z) * \left( \frac{z+\frac{1}{2}}{\sqrt{r^2+\left(z+\frac{1}{2}\right)^2}} - \frac{z-\frac{1}{2}}{\sqrt{r^2+\left(z-\frac{1}{2}\right)^2}} \right) dz. \tag{49}$$

From the above-described equations, by increasing the number of turns of the coil 212 per unit length at the end portions compared to the central portion as illustrated in FIG. 19, reduction in the electromotive force at the end portions of the film 214 can be compensated. Thus, the electromotive force generated in the film 214 in the recording medium conveying range can be equalized with the coil 212 having a reduced length compared to that in the second embodiment.

Although the example of the core has the ends and forms the open magnetic path in the third embodiment, the configuration of the third embodiment is effective also in the configuration with a core having an annular shape.

The rotating member is not limited to a film and may use a rigid roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261515, filed Dec. 18, 2013, which is hereby incorporated by reference herein in its entirety.

What is claimed is:

1. A fixing device for fixing an image on a recording medium by heating the recoding medium where the image is formed, comprising:

a cylindrical rotating member including an electrically conductive layer;

a coil configured to have a spiral shaped portion so that a spiral axis of the coil extends in a generatrix direction of the rotating member; and a magnetic member provided inside the spiral shaped portion, the magnetic member not forming a loop outside the rotating member, wherein magnetic fluxes are generated by an alternating current flowing in the coil, the magnetic fluxes passing inside a hollow of the rotating member in the generatrix direction, wherein the electrically conductive layer generates heat mainly by an induced current flowing in the electrically conductive layer in a circumferential direction of the rotating member, the induce current being induced by the magnetic fluxes, and wherein both longitudinal end portions of the magnetic member extend outside both respective longitudinal end portions of the rotating member, and both longitudinal end portions of the spiral shaped portion of the coil extend both the respective longitudinal end portions of the rotating member.

2. The fixing device according to claim 1, wherein magnetic resistance of the magnetic member is, with an area from one end to the other end of the maximum passage region of the image on a recording medium in the generatrix direction, equal to or smaller than 28% of combined magnetic resistances made up of magnetic resistance of the electrically conductive layer and magnetic resistance of a region between the electrically conductive layer and the magnetic member.

3. The fixing device according to claim 1, wherein 72% or more of the magnetic fluxes output from one end of the magnetic member in the generatrix direction pass over the outside of the electrically conductive layer and return to the other end of the magnetic member.

4. The fixing device according to claim 1, wherein a whole circumference of the electrically conductive layer generates heat regardless of rotating of the rotating member.

* * * * *